United States Patent [19]

Endo et al.

[11] 4,035,441

[45] July 12, 1977

[54] POLYESTER FILAMENT HAVING EXCELLENT ANTISTATIC PROPERTIES AND PROCESS FOR PREPARING THE SAME

[75] Inventors: Tadakazu Endo; Masanori Takeuchi; Tuneo Hanada; Kiyoshi Nakagawa; Hideo Komatsu; Itaru Nakamura, all of Mishima, Japan

[73] Assignee: Toray Industries, Inc., Japan

[21] Appl. No.: 482,463

[22] Filed: June 24, 1974

[30] Foreign Application Priority Data

| | | |
|---|---|---|
| Feb. 6, 1974 | Japan | 49-14537 |
| June 26, 1973 | Japan | 48:71285 |
| Feb. 6, 1974 | Japan | 49-14536 |

[51] Int. Cl.[2] ..... C08G 39/08

[52] U.S. Cl. ..... 260/860; 260/DIG. 17; 264/171; 264/DIG. 29

[58] Field of Search ..... 260/860, DIG. 17; 264/165, 171

[56] References Cited

U.S. PATENT DOCUMENTS

| | | | |
|---|---|---|---|
| 3,329,557 | 7/1967 | Magat et al. | 260/860 X |
| 3,381,057 | 4/1968 | Senco et al. | 260/860 |
| 3,410,927 | 11/1968 | Crovatt Jr. | 260/860 |
| 3,577,308 | 5/1971 | Van Drunen et al. | 264/171 |
| 3,652,713 | 3/1972 | Okazaki et al. | 260/860 |

*Primary Examiner*—Theodore E. Pertilla
*Attorney, Agent, or Firm*—Austin R. Miller

[57] ABSTRACT

A polyester filament in which a polyether-polyester block copolymer is dispersed as fine striae along the filament axis, at least one of which is substantially endless. Process for preparing the same includes a melt spinning apparatus with static mixing elements interposed between separate molten polymer feed passageways and spinneret holes.

18 Claims, 9 Drawing Figures

POLYESTER FILAMENT HAVING EXCELLENT ANTISTATIC PROPERTIES AND PROCESS FOR PREPARING THE SAME

The present invention relates to a polyester filament with excellent and durable antistatic properties having a specific resistance less than $10^{11}\Omega\cdot$cm.

It has been known that shaped articles, for example, fibers, bristles and films obtained from polyethylene terephthalate or copolymers thereof, polytetramethylene terephthalate or copolymers thereof, poly-1, 4-cyclohexane dimethyl terephthalate or copolymers thereof, polyesters obtained from para-oxyethoxy benzoic acid or copolymers thereof, polyethylene-1,2-bis (phenoxy) ethane-p,p'-dicarboxylate or copolymers thereof, and polyethylene-2,6-naphthalene dicarboxylate or copolymers thereof have high crystallinity, high softening points, and excellent performance in respect to tenacity, elongation, flexural strength, chemical resistance, light resistance and heat resistance, and therefore are of great value industrially.

However, aside from such merits as mentioned above, they also have dificiencies; their dyeability is poor, they are readily charged with static electricity, and in fabrics they are susceptible to pilling. Therefore, their uses are somewhat limited. Their tendency to charge with static electricity is one of their most serious deficiencies. In fabrics worn as clothing and the like, especially in dry air, they have a marked tendency to charge with static electricity, displaying undesirable properties such as crackling sounds and clinging to the body of the wearer. Further, they tend to absorb dust in many cases; they become quite soiled after only a limited period of wear. This so-called electrostatic obstacle is encountered not only in shaped articles consisting of polyester alone, but also in so-called mixed spun fibers consisting of polyester fibers spun with, for example, cotton, wool or rayon.

Heretofore, various attempts have been made to modify such polyesters to reduce the static electricity problems.

For example, in U.S. Pat. No. 3,329,557 (a), a fiber is disclosed consisting of a polyalkylene glycol and a polyester. And in U.S. Pat. No. 3,652,713 (b), an antistatic polyester fiber obtained by spinning a mixture of chips of a polyether-polyester block copolymer and chips of an ordinary polyester is disclosed.

However, the fibers of these references (a) and (b) have certain deficiencies in antistatic performance and industrial productivity. For example, the fiber of reference (a) is unferior in color tone, looking yellowish; further, when the fiber of reference (a) is washed or treated with water, its antistatic effect is lost, because although the polyalkylene glycol in the fiber of reference (a) is distributed throughout the fiber structure in the form of elongated particles having their long dimension parallel to the fiber axis, polyalkylene glycol is soluble in water. It therefore dissolves and is extracted by water. And, there is also a deficiency that fibrillation of the fiber is brought about due to the presence of the polyalkylene glycol which is insoluble in the polyester.

The fiber of reference (b) also has certain deficiencies. Namely, although a fiber of reference (b) which has been obtained by experimental spinning, using a test spinning machine, may have excellent antistatic properties as disclosed in examples of U.S. Pat. No. 3,652,713, this fiber when mass produced in a large spinning machine is unsatisfactory antistatic properties.

We have found that, in the fibers of reference (b) obtained from a large spinning machine, the polyether-polyester block copolymer is not dispersed as stria along the fiber axis, but is dispersed in the shape of fine particles or spindles; the fiber of reference (b) as produced upon a large spinning machines therefore has a specific resistance greater than $10^{12}\Omega\cdot$cm, and has poor antistatic properties. Further, investigation of the fiber of reference (b) has indicated that the polyether-polyester block copolymer in the fiber produced by a large spinning machine, undergoes "shear deformation" in the machine. In this case, when spinning is carried out while keeping the "shear deformation" of the polyether-polyester block copolymer low, even if the residence time in the spinning machine is long, a polyester fiber may be obtained in which the polyether-polyester block copolymer is dispersed as long beautiful stria, though not substantially endless. However, when the "shear deformation" of the block copolymer is high, said striae become indistinct, and the polyether-polyester block copolymer displays a behavior of dissolving in the surrounding polyester. On a laboratory production scale, a polyester fiber in which the polyether-polyester block copolymer is dispersed as striae, may exhibit undesirable trends in coloration, antistatic properties and other general physical properties. Further, operational reproducibility is poor, and the physical properties of the fiber product are varied to a large extent. Accordingly, increasing the molecular weight of the polyether-polyester block copolymer and/or raising the melt viscosity by introducing cross-linkages (as in U.S. Pat. No. 3,652,713) may be effective in a test or laboratory-scale spinning machine to reduce "shear deformation" as much as possible and to render "shear" comparatively insignificant. In an industrial scale spinning machine, however, the long distance from the melting hot plate to the spinneret introduces a great deal of "shear deformation" and the above-mentioned attempts to reduce shear have almost no effect in dispersing the polyether-polyester block copolymer as long striae in the polyester filament product.

Another difficulty in the process for preparing the fiber of reference (b) is that the polyether-polyester block copolymer tends to be dispersed as fine particles. Therefore it is necessary to use such a high-viscosity polyether-polyester block copolymer as to have a relative viscosity greater than 2.5. Such a copolymer is difficult to produce in actual practice because it requires solid-phase polymerization, or requires the polyether-polyester block copolymer to assume a three-dimensional structure, in order to obtain a high viscosity product.

We have conducted studies with reference to improvement of antistatic polyester fibers comprising various antistatic polymers, such as polyethylene glycol or derivatives thereof, or polyether-polyester block copolymers, and fiber-forming polyesters, such as polyethylene terephthalate. As a result, we have found that a polyester filament may be obtained, in which an antistatic polymer is distributed substantially endlessly along the filament axis, on a commercial or industrial scale, not by merely blending said two kinds of polymers and melt spinning the blended polymer as in U.S. Pat. Nos. 3,329,557 or 3,652,713, but instead by using a melt spinning technique in which the antistatic polymer and the polyethylene terephthalate are repeatedly divided and mixed by static mixing elements just prior to spinning. The polyether-polyester block copolymers exhibit especially excellent properties as antistatic polymers for producing fibers in such a melt spinning technique. These block copolymers facilitate the production of a fiber which overcomes the deficiencies of a mix spun fiber, which is also inferior in mechanical properties such as fibrillation resistance.

The general object of this invention, then, is to provide a synthetic polyester filament which has excellent antistatic properties which may be produced on an industrial scale, and which is free from the aforementioned deficiencies.

Another object of the present invention is to provide a synthetic polyester filament having good antistatic properties over an extended period of time.

Still another object of the present invention is to provide a synthetic polyester filament having good antistatic properties after treatment with a chemically active reagent such as an alkali.

Still another object of the present invention is to provide a synthetic polyester filament having good antistatic properties under the influence of high temperature.

Still another object of the present invention is to provide a highly oriented, amorphous, synthetic (pre-oriented) polyester yarn having excellent antistatic properties, and which is useful for texturing, such as drawing and false-twisting.

Still another object of the present invention is to provide a permanently antistatic, synthetic polyester filament having excellent fibrillation resistance.

Still another object of the present invention is to provide an effective process and an effective apparatus for achieving the aforementioned objects.

Still another object of the present invention is to provide an anti-static synthetic polyester filament which is free of coloration and has excellent homogeneity of mechanical properties in which an anti-static polymer, in a wide range of proportions or mixing ratios, is distributed as fine substantially endless striae along the filament axis.

Further objects of the present invention will become apparent from the following discription.

BRIEF SUMMARY OF THE INVENTION

The aforementioned objects of the present invention are achieved by a polyester filament having excellent antistatic properties which comprises a composition of a polyester and a polyether-polyester block copolymer, wherein said polyester filament has a specific resistance less than $10^{11}\Omega\cdot$cm and said polyether-polyester block copolymer is dispersed as fine substantially endless striae in the direction of the filament axis.

Such a polyester filament having excellent antistatic properties may be produced by separately filtering a molten polyester and a molten polyether-polyester block copolymer, thereafter instantly mixing the filtered molten polyester and the filtered molten polyether-polyester block copolymer in a static mixing device, and thereafter spinning the resulting mixture. A novel mix spinning apparatus in which this process may be carried out comprises one aspect of the present invention.

DESCRIPTION OF THE PREFERRED EMBODIMENTS

The antistatic polyester filament according to the present invention is composed of a polyester and a polyether-polyester block copolymer. The polyether-polyester block copolymer must be dispersed as fine substantially endless stria along the filament axis.

The antistatic effect is influenced by the way the polyether-polyester block copolymer is dispersed when it is dispersed as discrete particles, the effect of the present invention cannot be obtained.

The term "endless stria" as used herein, refers to fine, substantially endless, polyether-polyester block copolymer strand, which may not be of the same length as the polyester filaments. These "endless striae" may be observed, under a 300 *x* microscope, after treatment of the filament with osmic acid and o-chlorophenol. The polyether-polyester block copolymer, dispersed in the polyester filament is dyed by the osmic acid and the polyester is dissolved by the o-chlorophenol. "Endless striae" developed in this manner, are shown in FIG. 6. The existence of said endless striae can be confirmed, for convenience, by observing at least one continuous stria in any randomly sampled filament specimen of, for example, about 10 mm length, using the above mentioned microscopic method. The number of the endless striae may be at least one, preferably three. An upper limit for the number of stria is determined by the fact that said striae are substantially endless, as will be described hereinafter. The maximum diameter of the endless stria is within the range of 0.01 – 5 micron, preferably 0.1 –3 micron. When the maximum diameter of said stria is less than 0.01 micron, the antistatic performance of the filament obtained is not satisfactory for practical uses. When the maximum diameter of said stria is more than 5 microns, the mechanical properties of the filaments obtained are not satisfactory for practical uses. Developed in the same manner, polyether-polyester block copolymer, dispersed in a polyester filament, not as striae but in the shape of discrete particles or fine spindles or rods, is shown in FIG. 7.

Further, it is necessary that the anti-static polyester filament according to the present invention should have a specific resistance less than $10^{11}\Omega\cdot$cm. When the specific resistance exceeds $10^{11}\Omega\cdot$cm, static electricity is generated, for example, when a wearer puts on or takes off clothing made of such polyester filament. This is unpleasant to the wearer. Also, such polyester filament absorbs dust, and therefore soils more readily. It is preferable that a polyester filament according to the present invention have a specific resistance less than $10^{9}\Omega\cdot$cm. When the specific resistance is less than $10^{9}\Omega\cdot$cm, the problem of static electricity is not experienced, even in a very dry atmosphere.

It is also preferred that the specific resistance of the filament, after it is heat-treated in circulating air at 180° C for 5 minutes, shall be less than $10^{11}$ $\Omega\cdot$cm. Further, the specific resistance of the filament, after at least 5% of its weight is decreased by being treated with an alkali solution, should preferably be less than $10^{11}$ $\Omega\cdot$cm.

Hereinbelow, the present invention will be specifically explained, based on one embodiment of the process of the present invention.

The polyester for preparing a polyether-polyester block copolymer used in the practice of the present invention is a synthetic polyester, prepared from dicarboxylic acids, typified by aliphatic dicarboxylic acids such as oxalic acid, adipic acid, azelaic acid and sebacic acid, aromatic dicarboxylic acids such as terephthalic acid, isophthalic acid and 2,6-naphthalnedicarboxylic acid, or the ester-forming derivatives thereof, and alicyclic dicarboxylic acids such as 1,3-and 1,4-cyclohexanedicarboxylic acid, and diols such as ethylene glycol, diethylene glycol, propylene glycol, butanediol, p-xylylene glycol and 1,4-cyclohexanedimethanol. These polyesters may be homopolymers or copolymers.

It is preferable that the polyester constituent of said polyether-polyester block copolymer be amorphous or have a crystalline melting point less than 240° C, more preferably less than 220° C, and most preferably less than 200° C. If the polyester constituent of the block copolymer has a melting point above 240° C, the thermal degradation of the block copolymer is remarkable and its decomposition effects a drastic reduction of the antistatic properties of the filament within a few hours.

The aforementioned melting point of the polyester constituent of the block copolymer is the temperature at which melting is complete when a polyester having the same components as the polyester constituent is tested at a temperature gradient rate of 1° C/min and observed with crossed nicols under a microscope.

As the polyether-polyester block copolymer, the polyester segment of which is amorphous or has a crystalline melting point less than 240° C, melts or flows at a temperature in the vicinity of 240° C or at a temperature lower than that, it is possible to keep the block copolymer in a molten state in a reservoir or in piping for long periods without substantial degradation, until it is mixed with the polyester for spinning. As a result, even when the resistance time of the polyether-polyester block copolymer is extended, it is possible to limit thermal degradation within a permissible range and it is accordingly possible to obtain a polyester fiber having stable operability, uniform and excellent quality and excellent antistatic capacity. When the residence temperature is less than 200° C, the thermal decomposition of said polyether-polyester block copolymer is almost negligible, and when the resistance temperature is less than 160° C, there is no problem problems with thermal decomposition.

The polyether segment of the polyether-polyester block copolymer in the filament of the present invention is represented by the general formula $\{RO\}_n$ (wherein R is one or more types of divalent organic groups), having an average degree of polymerization of 10 – 1000.

Such compounds include, for example, polyethylene glycol, polypropylene glycol, polytetrahydrofuran, random copolymers of ethylene oxide and propylene oxide, block copolymers of ethylene oxide and propylene oxide and tetrahydrofuran. Polyethylene glycol and copolymers thereof are preferably used.

The polyether-polyester block copolymer used in the practice of the present invention is a linear polymer wherein the aforesaid two kinds of polymer segments bond chemically. The block copolymer is formed by condensation polymerization of a polyester-forming monomer in the presence of polyether.

The polyether may be added at any time before completion of polymerization, but the polyether should be added about 30 minutes before completion of the polymerization reaction in order to obtain the most satisfactory copolymer. Specifically, the following methods are among those which may be used.

1. Adding the polyether together with a dibasic acid component and a glycol component at the outset of the polymerization.

2. Synthesizing a bishydroxyalkyl dibasic acid ester (for example, bishydroxyethyl terephthalate) from a dibasic acid component and a glycol component in advance mixing this ester with the polyether, and polymerizing the resulting mixture.

3. Prepolymerizing a bishydroxyalkyl dibasic acid ester to prepare a polyester having a low molecular weight, mixing this polyester with the polyether and polymerizing the resulting mixture.

In the practice of the present invention, melt polymerization is carried out under conditions similar to those for melt polymerization of ordinary polyesters. And ester inter-change reaction is carried out under elevated pressure or under atmospheric pressure, followed by condensation polymerization under a highly reduced pressure.

The polyether-polyester block copolymer used in the practice of the present invention should contain about 10 – 97.5%, preferably 30 – 95% weight of the polyether constituent. For convenience, said polyether-polyester block copolymer will be hereinafter referred to as polymer A in describing the present invention.

In order best to develop the antistatic effect of the present invention, it is preferably that polymer A have a specific resistance less than $10^9$ Ω·cm, and is most preferable that it have a specific resistance less than $10^7$ Ω·cm.

To produce polymer A having a specific resistance less than $10^7$ Ω·cm, it is best to blend a proper amount of at least one of the following ionic substances with the polymer A in advance.

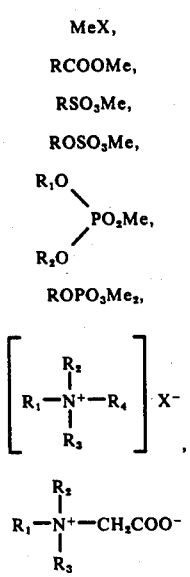

(wherein R, $R_1$, $R_2$, $R_3$, $R_4$ stands for alkyl, aralkyl and alkaryl groups each having 1 – 30 carbon atoms, Me stands for a metal ion of a metal belonging to Group I of the Periodic Table, and $X^-$ stands for a halogen ion or an alkyl sulfate ion having 1 – 30 carbon atoms).

It is also possible to blend said ionic substance with the polymer A at any stage, during or after synthesis of the polymer A, and further, it is possible to add said ionic substance to both the polymer A and the polyester to be mentioned later.

The polyesters which may be used in the filament of the present invention (hereinafter referred to as polymer B) are represented by polyethylene terephthalate, polytetramethylene terephthalate, polyethylene-2,6-naphthalene dicarboxylate, poly-1,4-cyclohexanedimethylene terephthalate, poly [ethylene-1,2-bis(-phenoxy)ethane-p,p'-dicarboxylate], poly-p-ethyleneoxy benzoate and copolymers thereof. A polyester, at least 80 mole % of which comprises ethylene terephthalate units is preferable.

Even if these polymers B are modified in some respect to affect the characteristics thereof, they may still be used in the present invention. Expecially for the purpose of improving the dyeability of the polymer B, it may be important to modify it with a small percentage of polyalkylene glycol, various organometallic salts of sulfonic acid, metal salt of phosphonic acid, metal salt of phosphorous acid, metal salt of carboxylic acid, aliphatic or aromatic amines by means such as copolymerizing, adding, mixing, impregnating or grafting.

The content of the polyalkylene glycol segment in the polyester filament according to the present invention is 0.01–5.0% by weight, more preferably 0.05 – 1.0% by weight. When said content is less than 0.01% by weight, the specific resistance of the obtained filament is more than $10^{11}$ Ω·cm and the antistatic effect is insufficient; when said content is more than 5.0% by weight, other undesirable physical properties, e.g., low crimp resiliency (CR %), result.

In order to ensure that the antistatic capacity of the polyester filament of this invention is not lost upon treatment of said polyester filament at high temperature, it is preferable to blend a proper amount of an antioxidant with said polyester filament.

The anti-oxidation effect of the antioxidants useful in this invention may be measured by the following method.

Namely, when 99 parts of a nonionic surface active agent, obtained by adding 10 moles of ethylene oxide to one mole of lauryl alcohol, and 1 part of an antioxidant are mixed, and the curve of this composition upon differential thermal analysis is measured in air using an α-alumina carrier with a temperature gradient of 20° C/min. Those antioxidants which can shift the oxidative decomposition temperature of the surface active agent toward at least 180° C in this curve of differential thermal analysis can be used in the present invention with excellent effect. For comparison, the oxidative decomposition temperature of the agent without any antioxidant is about 116° C under the same measuring conditions.

Specific examples of such antioxidant which may be used in the present invention are 2,6-di-tert-butyl-p-cresol, polymerized 2,2,4-trimethyl-1,2-dihydroquinoline, 4,4′-thiobis(6-tert-butyl-m-cresol), zinc-di-n-butyl dihydrocarbamate, tetrabis [methylene(3,5-di-tert-butyl-4-hydroxy hydrocinnamate] methane, tris(2-methyl-4-hydroxy-5-tert-butylphenyl)butane and 1,3,5-trimethyl-2,4,6-tris(3,1-di-tert-butyl-4-hydroxybenzyl) benzene.

It is possible to blend said antioxidant with either or both of the polymer A and the polymer B at the time of polymerization of these polymers A and B and blend or impregnate said antioxidant with the polymer A and/or the polymer B after their polymerization. It is, however, preferable to blend said antioxidant with the polymer A when it is polymerized, contributing to stabilization of the polymerization step.

Next, a specific process for preparing a polyester filament excellent in antistatic properties according to the present invention will be explained by reference to the accompanying drawings, in which like elements are given like reference numerals.

In the drawings, FIG. 1, FIG. 3 and FIG. 4 are sections of embodiments of the melt spinning apparatus which performs the instant mixing step of the present invention which is preferably used for practicing the process of the present invention and are useful in making the filaments of the present invention.

FIGS. 2(*a*), 2(*b*), and 2(*c*) are detailed sectional views of a space or chamber where the polyester meets the polyether-polyester block copolymer in an apparatus of the type shown in FIG. 1, wherein FIG. 2(*a*) shows wherein a form of pipe apparatus slanted is provided for discharging the polyether-polyester block copolymer.

Figure 1:
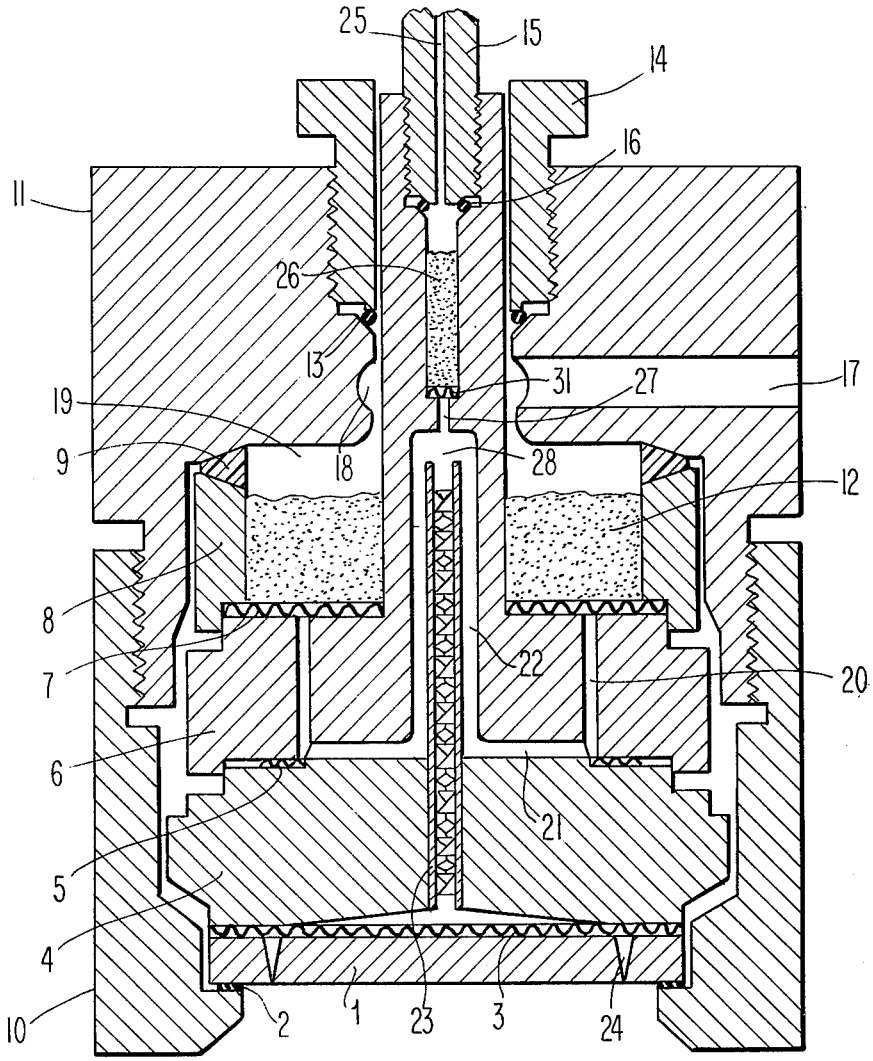

Referring more specifically now to FIG. 1, there is shown an assembled spinning apparatus consisting of pack block 11, spinneret 1, mixing plate 4, pressure supporting plate 6, spacer 8 and annular bolt 14 together with filters 3, 7, 31 and gaskets 2, 5, 9, 13, to which apparatus (sometimes referred to herein as a "pack") is connected tip 15 of a polyether-polyester block copolymer (polymer A) supply system via gasket 16, making it possible to carry out melt spinning with instant mixing. The polyester (polymer B) constituting the main feed, passes through conduit 17 and reaches space 19 via annular space 18, passing through filter layer 12, thereafter, rising in annular space 22 via conduit 20 and space 21, meeting in meeting space or chamber 28 with polymer A separately supplied via conduit 25, filter layer 26 and small hole 27. Thereafter said polymers A and B pass through the opening of static mixing part 23 and are immediately spun from spinneret orifices in spinneret 1. When the polymer A is filtered outside said pack, it is possible to omit the filter layer 26. In any case, said pack is designed so that the residence time of the polymer A in said pack is minimized.

As mentioned above, in the present invention, the polymer A and the polymer B are supplied to the static mixing part after separately undergoing necessary filtration and the resulting mixture is spun into filaments without being filtered again. Therefore, the resulting polyester filament has excellent antistatic properties and spinnability as well.

Figure 2:
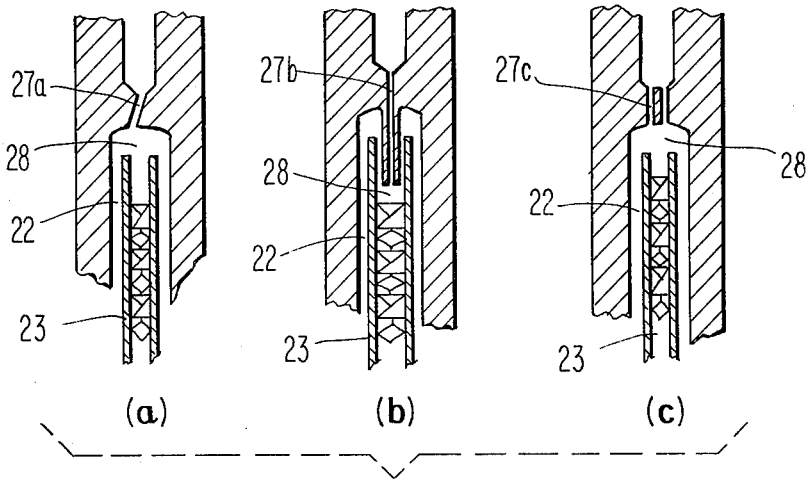
FIG. 2(*b*) shows and apparatus wherein the pipe for discharging the polyether-polyester block copolymer is constructed to protrude and FIG. 2(*c*) shows a construction wherein a plurality of pipes are provided for discharging the polyether-polyester block copolymer.

The structure of the spinning assembly in the vicinity of meeting space 28 where polymer B and polymer A meet is not particularly limited; various designs are possible. For example, as shown in FIG. 2(*a*), pipe **27*a*** for discharging polymer A may be provided aslant (i.e., not parallel to the axis of the inlet conduit of polymer A); as shown in FIG. 2(*b*), pipe **27*b* for discharging polymer A may be made to protrude into the entrance of the tubular housing of static mixing part 23 and polymer A and polymer B may thus be made to meet at a place where the flow of polymer B is downward toward mixing part 23; and as shown in FIG. 2**(*c*), a plurality of discharge pipes 27*c* may be used to introduce polymer A into meeting space 28.

The actual meeting space for polymers A and B may also be the side of the entrance of the mixing part as mentioned above; a meeting space may also be provided to cause polymer A to flow into a middle part of the mixing part from a side wall inside the mixing part.

It goes without saying that these structures are mere illustrations and the structure in the vicinity of the meeting space or chamber is not limited thereto. When the amount of polymer A being added is very small, it is especially recommended to use a protruding discharge pipe structure as shown in FIG. 2*b*.

A process including the steps of supplying polymer A and polymer B to the static mixing part and spinneret in such a manner that polymer A forms a core component of a sheath-core configuration in polymer B is especially preferable from the viewpoint of antistatic properties and spinnability.

The static mixing part 23 is a part where mixing of the conjugate components, which first meet in space 28, is carried out. As the static mixing element constituting said mixing part, the structures disclosed in U.S. Pat. No. 3,051,453, U.S. Pat. No. 3,195,865 or U.S. Pat. No. 3,286,992 are especially effective. However, said mixing elements are not limited thereto, and any structure may be adopted so long as it has a static mixing effect. It is preferable that the mixing plate 4 equipped with this static mixing part be disposed directly in front of spinneret 1 so as to swiftly spin a fluid from spinneret 1 after the polymers are mixed by the mixing plate. The mixing plate and the mixing part must be designed so as to sufficiently develop the additive effect of polymer A in the filaments produced. In FIG. 1, an example is shown in which the mixing part is constituted by the mixing plate 4 and a protruding auxiliary pipe having mixing elements inside. However, in order to take advantage of the available space, the mixing part may be designed so that the pipe is made to protrude below the mixing plate. Furthermore, the pipe may be made to protrude both upwardly and downwardly from mixing plate 4, and it may be designed so that there is no protrusion either upwardly and downwardly and the mixing part is accomodated inside the mixing plate in, for example, a spiral or circumferential state.

The shape of the protrusion need not be cylindrical, and the mixing elements may be of various shapes as occasion demands. It is also possible to fit the mixing elements into a curved or bent passage and to control the thickness of the mixing plate or the length of the auxiliary protrusion.

The mixing part is provided, in still another possible design, in a space between both ends of this passage. As to the method of fixing the mixing part into the assembly, when it is a shaped article, welding or brazing may be used.

When the mixing elements are granular substances, they may be sintered or they may be supported by metal screen at the lowest reaches of the mixed stream. When the mixing elements per se include an outer wall which is capable of forming a passage, it is possible to use the same by, for example, doing without the protruding auxiliary pipe. It may thus be adopted to form a plurality of mixing passages, if necessary.

When polymer A and polymer B are mixed by such static mixing elements, two-dimensional fine dispersion is inevitably achieved and polymer A assumes the shape of substantially endless striae in a direction extending along the length of the mixed stream (and the subsequently formed filaments). In the present invention, this mixed fluid is immediately spun from ordinary spinneret orifices without further subjecting the same mixed fluid to filtration, whereby the polymer A which is a minor component comes to exist as substantially endless striae extending in a direction along the length of the filament axis in the filament thus produced. It is necessary to swiftly subject the mixed fluid, consisting of the two-dimensionally distributed fine dispersion of polymer A in polymer B produced by the mixing elements, to spinning to make it a filament.

If this mixture at this stage is further passed through sand particles or a sintered metal, the specially formed polymer A, arranged as striae, is cut into pieces and three-dimensionally distributed in a fine dispersion, which defeats the purpose of the present invention. While a surface filter such as a metal screen may be used, it is preferable to avoid, or at least to minimize, further dispersion of polymer A in order not to adversely affect the spinnability or characteristic requirement of the fiber obtained in accordance with this invention. To this end, the mixing time of polymer A and polymer B (the time delay between mixing and spinning) is preferably less than 180 seconds and the number of mixing elements or stages constituting the mixing part is an integer (the nearest whole number) within the range of $$\left[\frac{12}{n}\right] \text{to} \left[\frac{32}{n}\right]$$

(wherein $n$ is an integer within the range of 2 – 12, expressing the dividing function of the mixing elements). Specifically, when $n$ is 2, said number is 6 – 16, more preferably 8 – 14. $n$, the dividing function, is the number of divisions in the fluid stream which is made by each element or stage of the mixing part.

In other words,, in the mixing part, when it is assumed that one mixing element gives one stage mixing, it is preferable to carry out $$\left[\frac{12}{n}\right] - \left[\frac{32}{n}\right]$$

stages of mixing.

When the number of mixing elements is less than $$\left[\frac{12}{n}\right],$$

the drawability of the resulting fiber is lowered, and the average maximum diameter of said substantially endless stria in the filament is, depending on the amount of the polyether-polyester block copolymer in the polyester composition, not substantially satisfied within the range specified in this invention; if this number exceeds $$\left[\frac{32}{n}\right],$$

mixing becomes so excessive that the substantially endless striae specified in this invention can not be attained, instead resulting in fragmentary particles or rods, and the antistatic effect of the resulting fiber diminishes which is not preferable. These mixing elements may be made to form one passage as a whole or to form two or more parallel passages; in any event, it is preferable to use a total number of mixing elements within the aforesaid range. Accordingly, the number of elements in each passage is preferably within the range of $$\left[\frac{12}{n}\right]-\left[\frac{32}{n}\right]$$

divided by the number of parallel flows. If more than one passageway is formed in the mixing part, the passages may be of either the same or different geometries.

The filter layer 12 is used for removing foreign substances of sizes, exceeding the standard size from polymer B; granular substances such as sand, glass bead and stainless steel powder or other known materials such as a sintered metal, metal screening or sintered metal screening may all be used. The filtrability of these filters may be decided on a practical basis as occasion demands. In case removal of foreign substances by filtration is carried out before polymer A and polymer B enter the pack or spinning assembly, it goes without saying that the filter layers inside the pack may be omitted.

Filter 7 is used for supporting filter layer 12 when granular substances comprise filter layer 12. Filter 7 may comprise one or more sheets or shaped articles such as a metal screening or a sintered metallic element, at least one sheet of which has sufficiently small openings so as to prevent said granular substances from passing therethrough. The periphery of filter 7 is framed with, for example, aluminium plate so as to obtain a sealing effect. In case a shaped article such as a sintered metallic element, a metal screening or a sintered metal screening is used for the filter layer 12, said filter 7 may be omitted. In that case, it is preferable to use gaskets so as to make complete the sealing of the contacting part of the spacer 8 and the pressure supporting plate 6.

As the surface filter 3, it is effective to use a metal screening having openings which are smaller than the smallest area of the spinneret orifices. It is, however, possible to omit the surface filter 3 in some applications. In this case also, it is preferable to use gaskets to complete the sealing at the contact part of the spinneret 1 and the mixing plate 4.

Figure 3:
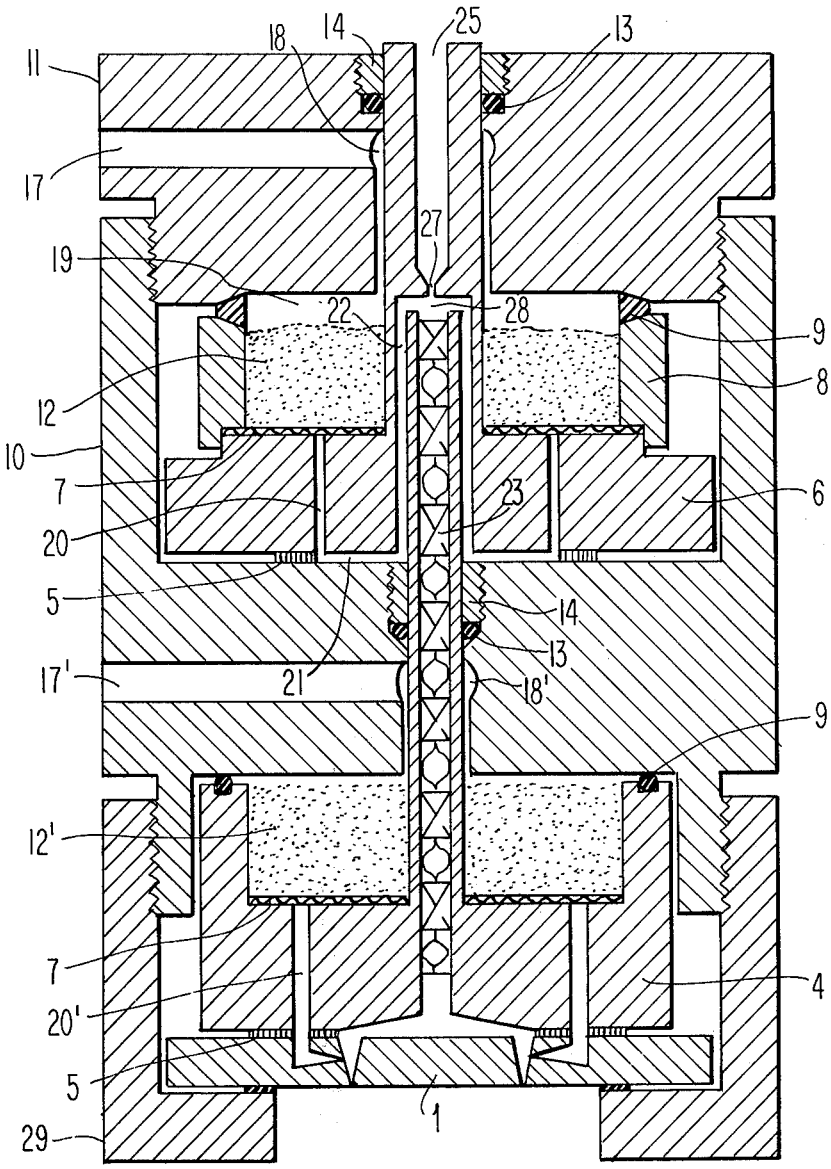

FIG. 3 is another embodiment of the apparatus for efficiently practicing melt spinning with instant mixing of additives in accordance with the present invention. This structure is basically the same as that of FIG. 1. It includes pack bodies 10, 11, 29, spinneret 1, mixing plate 4, pressure supporting plate 6, spacer 8, annular bolt 14 and filter 7, assembled together with gaskets 5, 9, 13. To this pack the tip of a polymer A supply system (not shown) is connected to conduit 25, making it possible to carry out melt spinning with instant mixing.

Polymer B, for conjugate or parallel spinning, passes through conduit 17, reaching a space 19 via annular space 18, subsequently passing through filter layer 12, and thereafter rising in an annular portion 22 via a conduit 20 and a space 21, meeting polymer A. Polymer A is supplied separately via conduits 25 and 27 in meeting space of chamber 28. Polymer B passes through the entrance opening of static mixing part 23, and is mixed therein with polymer A and then supplied to spinneret 1.

In this embodiment, a filter layer for polymer A is not provided inside the pack. However, in this case, it is necessary to provide such filter layer inside a polymer feed passage before polymer A enters the pack. If this filter layer is not provided, the spinnability of the composition is adversely affected.

Another polymer B′ comes down in annular portion 18′ via conduit 17′, passing through filter layer 12′, thereafter, being supplied to spinneret 1 via conduit 20′ and spun together with polymer B having polymer A dispersed therein to obtain a conjugate filament.

In this case, by properly selecting the structure of the spinneret 1, it is possible to spin a side-by-side, concentric or eccentric conjugate filament. It is also possible to spin polymer B′ supplied from conduit 20′, from separate spinneret orifices provided for spinning the polymer B′ parallel to those provided for spinning the polymer A-polymer B dispersion.

Figure 4:
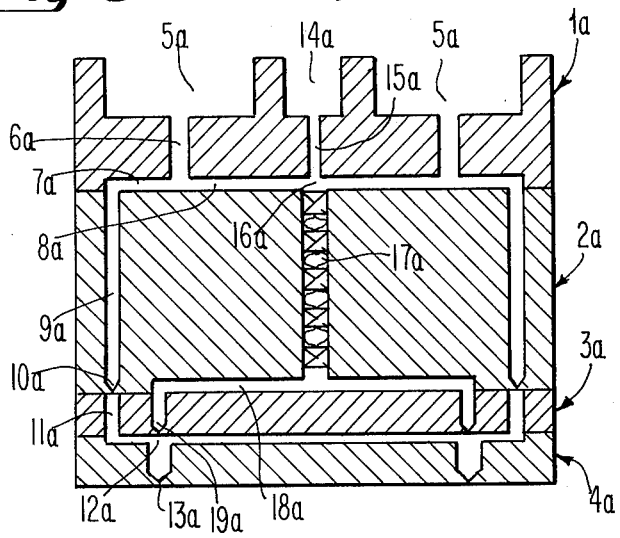

FIG. 4 shows another embodiment of the present invention in which body members **1*a*, 2*a*, 3*a*, 4*a*, are assembled using gaskets, if necessary. Polymer B (a polyester main fluid), constituting also a sheath component in this case, is measured and supplied to receiving openings 5*a* and divided into passageways 7*a* and 8*a* via a plurality of holes 6*a*. Polymer B flowing in passageway 7*a* reaches spinneret opening spaces via communicating passageways 9*a*, 10*a*, 11*a*, and is extruded through spinneret orifice 13*a* as the sheath of a sheath-core type conjugate filament formed by orifice 13*a*.**

On the other hand, polymer B passageway **8*a* meets polymer A (a polyether-polyester block copolymer) in meeting space or chamber 16*a*, polymer A being separately measured and supplied via receiving opening 14*a* passageway 15*a*, immediately passing through a static mixing part 17*a* consisting of static mixing elements. The polymer A-polymer B dispersion thus formed becomes a core component of a sheath-core type conjugate fiber as it enters space 12*a* via passageway 18*a* and a hole 19*a* and is discharged through spinneret orifice hole 13. In this case, the ratio of the core component to the sheath component is automatically controlled by the fluid pressure drop in the various passages leading to space 12*a*.**

The undrawn yarn thus spun may be either taken up, at a typical rate of about 1000 m/min, to be made into an ordinary undrawn yarn or it may be taken up at a higher rate to be made into a pre-oriented polyester yarn. It is possible to subject the spun yarn to all the hitherto known high degree processings, such as continuous or discontinuous drawing, to an extent of several times its length, to adjust the tenacity and elongation. It may also be subjected to a proper heat-treatment or shaping to transform the spun yarn to a so-called "textured yarn". Further, it may be dyed and/or treated with a chemical reagent.

Several examples of excellent polyester filament made according to this invention are described below.

Filaments of the present invention may be taken up at a high rate such as 1500 m/min, or even in excess of 2000 m/min and made into a pre-oriented polyester yarn without decreasing their antistatic capacity. These filaments have excellent antistatic properties.

Especially from a pre-oriented yarn consisting mainly of polyethylene terephthalate having a birefringence of $13 \times 10^{-3} - 80 \times 10^{-3}$ and an elongation at break of less than 250%, a textured yarn having improved antistatic capacity and advanced quality is obtained by drawing, at a draw ratio not more than 2.5 times and false twist texturing, either sequentially or simultaneously.

Figure 5:
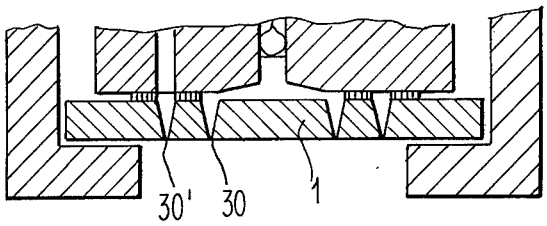
FIG. 5 is a detailed sectional view of a parallel spinning spinneret used for obtaining a polyester filament mixed yarn of the present invention.

When a useful antistatic polyester filament mixing yarn is examined by reference to FIG. 5, the spinneret 1 of FIG. 3 is replaced by a spinneret for parallel spinning having a plurality of spinneret orifices of 30, 30' as shown in FIG. 5. Two kinds of polymers constituting a filament mixed yarn, (abbreviated as polymer B and polymer B', respectively) are supplied to the conduits 17, 17' (of FIG. 3) and they are spun separately from a plurality of the spinneret orifices 30, 30' as described in connection with the spinneret of FIG. 3. To polymer B, supplied from conduit 17, is added at the meeting chamber 28, polymer A separately supplied via conduits 25, 27. Accordingly, in filaments discharged from the plurality of the spinneret orifices 30, the aforementioned polymer A is blended as substantially endless stria. On the other hand, filaments discharged from the plurality of the spinneret orifices 30' are of the polymer B' not positively exhibiting antistatic performances. However, a filament mixing yarn obtained by simultaneously taking up filaments spun from the spinneret orifices 30, 30' is, notwithstanding being mixed with filaments consisting of the polymer B' not containing the polymer A, found to develop excellent antistatic properties. Surprisingly, so long as the content of polymer A in the total filament is the same, this filament mixed yarn containing a fiber not containing polymer A and the aforementioned filaments blended with polymer A exhibit antistatic properties of exactly the same level.

Another advantage of the present invention is the improvement in alkali resistance. Usually, for the purpose of improving the aesthetic properties, drapability and wrinkle recovery of a polyester fabric, an aqueous alkali solution has been applied to said fabric to chemically decompose and remove the surface of the filaments. An antistatic polyester filament blended with a polyether-polyester block copolymer is similarly treated with alkali sometimes, and it is necessary that the antistatic properties be retained after such treatment. Heretofore, it has been found that, depending upon the kind of polyether-polyester block copolymer used, these polyester filaments are discolored and remarkably downgraded in antistatic performance upon treatment with alkali. And it has been found that in order to retain the excellent antistaic properties after this treatment with alkali, there is a preferable range for the polyester segment of the polyether-polyester block copolymer.

Namely, it is preferable that at least 40 mole % of the constituent units of the polyester segment of the polyether-polyester block copolymer be an ester unit synthesized from one or more members selected from the group consisting of (1) an aliphatic or alicyclic oxycarboxylic acid having at least 2 carbon atoms and the ester-forming derivatives thereof, (2) an aliphatic or alicyclic dicarboyxlic acid having at least 3 carbon atoms and the ester-forming derivatives thereof, (3) an aromatic dicarboxylic acid or oxycarboxylic acid having a group ether-linked to an aromatic ring having a carboxylic group and the ester-forming derivatives thereof, (4) an aromatic dicarboxylic acid or oxycarboxylic acid having a substituent group at the ortho-position toward a carboxyl group and the ester-forming derivatives thereof, and (5) an aliphatic or alicyclic glycol having at least 3 carbon atoms.

In case the amount of said ester unit selected from groups (1) – (5) above comprise less than 40 mole % of the polyester segment of the block copolymer, the stability against alkali treatment of polymer A (the block copolymer) lowers and the antistatic performance of woven or knitted polyester fabric made therefrom deteriorates after being treated with alkali.

As the remaining polyester segment units (of the block copolymer), one or more kinds selected from the group consisting of an ordinary dicarboxylic acid components, oxycarboxylic acid components and glycol components (other than those referred to in said groups (1) – (5) above) may be used.

A sheath-core type conjugate filament made in accordance with the present invention comprises a sheath component consisting of a polyester not containing polymer A and a core component consisting of a polyester containing the polymer A, distributed as substantially endless striae along the length of the filament. A fiber having excellent antistatic properties is thus obtained by blending a very small amount of polymer A. The fact that the hydrophilic polyether-polyester block copolymer is blended only in the core component and does not exist in the surface layer of the polyester, provides certain advantages. For example, the antistatic properties are stable even when said conjugate filament is stored for a long period of time. In addition, when such filament is treated with chemicals as a filament mixed yarn, uniform treatment is possible. Moreover, because polymer A, which might fibrillate, is blended as the core component only, such conjugate filament has a fibrillation resistance which is not different than that of an ordinary polyester filament.

In the present invention, polymer A, which is the component for imparting the antistatic properties, is blended as substantially continuous fine striae in a direction along the filament axis of the filament product. Excellent antistatic properties can be thus obtained on an industrial scale by blending a very small amount of polymer A.

Problems of deterioration of physical properties of prior art fibers having relatively large amounts of an antistatic agent therein are completely eliminated in the use of the fiber of the present invention. Moreover, in a fiber formed according to the present invention, polymer A is instantly mixed with polymer B immediately before they are discharged from the spinneret orifices, so that any non-uniformity between the respective polymers is not evident in the apparently homogenized product. This also enhances spinnability, which is an important advantage in the actual manufacturing process.

The cross-sectional shape of the antistatic polyester filament of the present invention is not particularly limited, but triangular, pentagonal and other shapes, to said nothing of circular, may be obtained by properly selecting the shape of the spinneret orifices.

It is an important characteristic of the present invention that upon preparing a polyester filament of the present invention, there are very few limitations with respect to the apparatus used in its preparation, so long as polymer A and polymer B are separately melted and filtered and thereafter instantly mixed with each other immediately before spinning. The present invention may be produced in presently known type of pressure melter-type apparatus.

An extruder or a continuous-polymerization spinning apparatus may be used, also. Conventional anti-static polyester filaments are prepared mainly by chip blending, and the spinning apparatus therefor is limited to a pressure melter-type apparatus. Even if an extruder is used for the preparation of such filament, it is not possible to develop a sufficient anti-static effect, because the mixing is three-dimensional.

Figure 6:
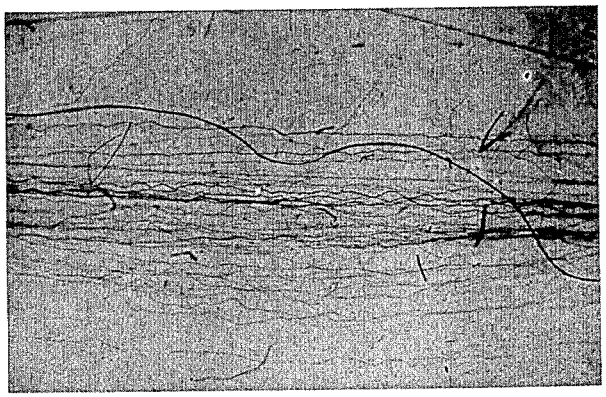
FIG. 6 is a photomicrograph (300 X), of a test specimen obtained by dyeing a polyester filament of the present invention, having excellent antistatic performance, with osmic acid and dissolving the dyed filament in σ-chlorophenol.

The existence of a polyalkylene glycol segment contained in the polyester filament obtained in accordance with the present invention may be confirmed by treating the polyester filament with osmic acid, and thereafter making the treated filament into a very thin cut piece, or by dissolving the treated filament in a proper solvent and observing said cut piece or dissolved solution with an optical microscope or electron microscope. For example, a photomicrograph (300x) of the product obtained by dyeing a polyester drawn yarn of the present invention, obtained with ten mixing elements and an amount of polyester segment of 0.3% by weight, with osmic acid and dissolving the dyed yarn in o-chlorophenol is shown as FIG. 6, from which it is apparent that the polyetherpolyester block copolymer is present in the form of long striae and the number of said straie can be counted as about forty to fifty, corresponding to the calculated number of forty-three, and the average maximum diameter of said striae about 0.3 micron.

The proportions of said polyalkylene glycol segment may be determined by of dissolving the polyester fiber in a proper solvent or decomposing said fiber by use of an acid or alkali and titrating the polyalkylene glycol in the resulting decomposed liquid with sodium tetraphenyl borate, etc. according to the method described in Analytical Chem., 37, 671 (1965), etc. or by estimating the polyalkylene glycol segment through analysis with a wide line nuclear magnetic resonance spectrum.

Hereinbelow methods of measuring or estimating the characteristic values of polyester filament of the type of interest in the present invention are listed.

Specific resistance of a filament:

Filaments to be measured are put into a 0.2 wt % aqueous solution of a commercially available anionic, weakly alkali detergent, and washed with an electric washer for 2 hours. After washing with water and drying, the electric resistance R (Ω) of a filement having a length of 5 cm and a size of 1000 denier is measured by using a super insulation meter at a direct current voltage of 500 volts at 20° C, in an atmosphere having a relative humidity of 40%. The specific resistance (Ω·cm) is calculated from R in accordance with the following equation.

$$R_s \text{ (specific resistance)} = \frac{R \times D}{9 \times L \times d} \times 10^{-5}$$

R: measured resistance (Ω)
D: total denier of the specimen
L: length (cm) of the specimen
d: density (g/cm$^3$) of the specimen
$R_s$: specific resistance of the specimen (Ω·cm)

Specific resistance of the polymer:

For solid polymers, specific resistance is based on the resistance between both ends after the polymer is made into a specimen in a state of gut or rod and a voltage of 500 V is impressed; for liquid polymers, it is a value determined from the resistance between 2 silver electrodes inserted in a specimen (impressed voltage again 500 V) measured in an atmosphere at 20° C. and at a relative humidity of 40% for more than 200 hours until the obtained value of resistance is considered to substantially converge to a constant value, while keeping the temperature at 20° C during the period. The specific resistance of the polymer is a value calculated from the resistance (R) in accordance with the following equation.

$$\rho = \frac{R \times S}{L} = \frac{R \times W}{L^2 \times d}$$

ρ: specific resistance (Ω·cm) of the specimen
R: measured resistance (Ω)
W: weight of the specimen (g)
S: cross-sectional area (cm$^2$) of the specimen
d: distance between electrodes (cm)
L: length (cm) of the specimen Crimp resiliency (CR value):

The crimp resiliency of polyester textured yarn in the present invention is estimated by a value obtained by the method of H.A.T.R.A. (which is the same as JIS-L1077) after heat-treating said textured yarn at 90° C for 30 minutes.

Intrinsic viscosity:

Measured in σ-chlorophenol at 25° C.

Hereinbelow, the present invention will be explained in detail by reference to examples, in which "parts" means "parts by weight".

EXAMPLE 1

In a pack structure as shown in FIG. 1, the static mixing part consisted of nine static mixing elements fixed in a pipe having an inner diameter of 6.3 mm. Each of said mixing elements was formed by twisting a rectangular plate 180°. The elements were arranged so that elements of right-handed and left-handed curvature alternated with one another, the angle between contacting edges of adjacent elements being about 90°, all as disclosed in U.S. Pat. No. 3,286,992. Polymer B, in this example, was obtained by melting, at 290° C, polyethylene terephthalate having an intrinsic viscosity of 0.66. This was supplied to conduit 17 at a rate of 60 g/min. Morandum particles having an average particle diameter of 60 mesh formed filter layer 12, the height of which was about 20 mm. Polymer B passed through this layer and thereafter was introduced to meeting space or chamber 28 via the spaces or passageways 21 and 22.

To form polymer A, 102 parts of polyethylene glycol (molecular weight 20,000) and 0.15 part of calcium acetate as a catalyst for an ester interchange reaction was added to 69.05 parts of dimethyl terephthalate and 43.90 parts of ethylene glycol. An ester interchange reaction was carried out while distilling off methanol at a temperature of 140° – 220° C. Thereafter, 0.07 part of trimethyl phosphate and 0.17 part of Irganox 1010 (product of Ciba-Geigy Ltd.), as an antioxidant, and 17 parts of sodium dodecylbenzenesulfonate were added to the reaction product, and the mixture was polymerized at a temperature of 255° C under a highly reduced pressure of about 0.2 mm Hg for 4 hours to obtain an opaque polymer A having a good color tone and a relative viscosity of 2.8 measured in a 1% solution of σ-chlorophenol at 25° C. The specific resistance of the polymer A was $2 \times 10^6 \Omega \cdot cm$.

This polymer A, melted and kept at 275° C., was discharged into the space 28 via the conduit 25, filter layer 26, and small hole 27 of the apparatus shown in FIG. 1. The rate of feed of polymer A was controlled so that the amount of the polyalkylene glycol segment in the filament product was 0.48% by weight. After passing through static mixing elements, with an average residence time therein of 2.6 seconds, the polymer A-polymer B mixture was then spun within about 12 seconds thereafter. A spinneret having 48 spinneret orifices, each having a diameter of 0.3 mm was used and the spun filament was taken up at a rate of 1,000 m/min by a conventional method to obtain an undrawn yarn, which was then drawn by a conventional method to obtain a 150 denier drawn yarn having an elongation of about 30%. The number of the endless stria was about eleven, and the average maximum diameter was about 0.6 micron.

Said polyester drawn yarn had a specific resistance of $3.5 \times 10^8 \Omega$.cm, and it had very good antistatic properties.

Next, the 150 d/48 filament yarn thus obtained was false-twisted using a false-twist machine, having the commercial designation CS-9, manufactured by Earnest Scragg Co. at a spindle revolution rate of 180,000 rpm, a set temperature of 240° C., number of false-twist of 2,500 T/m and a feed rate of 2%.

When the crimp resiliency (CR %) of the obtained textured yarn was sought, it was 41.1%.

The CR value of a comparable textured yarn obtained by false-twisting a 150 d/48 filament polyester yarn without polymer A dispersed therein, was 44%. (Filaments with a CR value less than 40% have insufficient elasticity for application in certain fields.)

EXAMPLE 2

Example 1 was repeated except that eight static mixing elements were used and the amount of the polyalkylene glycol segment in the fiber was 0.25% by weight.

The specific resistance of the said undrawn yarn was $4.2 \times 10^8 \Omega$.cm, and said yarn exhibited a very excellent antistatic effect. Throughout a long period of spinning and drawing, no trouble occurred and stable yarn spinning was possible. The number and the average maximum diameter of the endless stria in the filament obtained were about five and about 0.6 micron respectively.

COMPARATIVE EXAMPLE 1

The same polyether-polyester block copolymer used in Example 1, except in the physical form of chips, was mixed with the same polyethylene terephthalate chips used in Example 1. The resultant mixture was spun, by a small pressure melter-type spinning machine for test (spinning temperature 290° C, residence time 3 minutes, discharging amount 10 g/min, number of spinneret orifices 12, no sand layer in the pack, take-up velocity 1,000 m/min) and by a one head 8-pack type large pressure melter spinning machine for mass product (spinning temperature 290° C, residence time 15 minutes, discharging amount 60.5 g/min, number of spinneret orifices 48, a sand layer was used in the pack, consisting of a 20 mm-layer of 60 mesh morandum particles, take-up velocity 1,000 m/min) and drawn, respectively.

The physical properties of the resulting 150 d/48 filament drawn yarn are shown in Table 1.

Table 1

| Yarn No. | Melt spinning machine, type | Polyalkylene glycol segment content in yarn (wt%) | Specific resistance of the drawn yarn (Ω.cm) | CR value (%) |
|---|---|---|---|---|
| 1 | Small spinning machine for test | 2.0 | $1.4 \times 10^8$ | 32.3 |
| 2 | " | 0.5 | $9.3 \times 10^8$ | 40.5 |
| 3 | Large spinning machine for mass production | 0.5 | $>4 \times 10^{14}$ | 40.7 |
| 4 | " | 2.0 | $>4 \times 10^{14}$ | 31.6 |
| 5 | " | 0.0 | $>4 \times 10^{14}$ | 43.6 |

From Table 1, it is apparent that with the small test-type spinning machine, yarns having satisfactory antistatic properties and firmness, as textured yarns, were obtained. However, with the large-type spinning machine for mass production, yarns having good antistatic properties could not be obtained at all.

Figure 7:
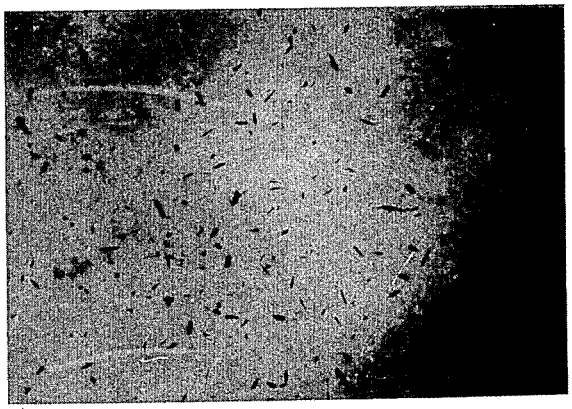
FIG. 7 is an electromicrograph (30000 X) of a test specimen obtained by dyeing an antistatic polyester filament obtained by a conventional method with osmic acid and dissolving the dyed filament in σ-chlorophenol.

An electronmicrograph (30000 X) of yarn No. 3 dyed with osmic acid and dissolved in σ-chlorophenol is shown as FIG. 7, from which it is observed that the polyether-polyester block copolymer is dispersed three-dimensionally in the form of rod-like particles, which can be considered as the reason why the antistatic effect did not develop.

COMPARATIVE EXAMPLE 2

Example 1 was repeated, using ten mixing elements with the polyalkylene glycol segment comprising 5.5% by weight of the filament product A drawn yarn was obtained.

Although this drawn yarn had a specific resistance of $9.5 \times 10^8 \Omega$.cm, and was good in antistatic properties, it had a poor CR value of 29.5%.

EXAMPLE 3

87.7 parts of terephthalic acid, 53.1 parts of 1,4-cyclohexane dimethanol and 110.0 parts of tetramethylene glycol was heated to a temperature of 170° – 210° C; water was distilled off as it was produced and an esterification reaction was carried out; thereafter, 34.0 parts of polyethylene glycol (molecular weight 20,000) and 0.17 part of Irganox 1010 (product of Ciba-Geigy Ltd.) as an antioxidant and 0.17 part of $NaHTi(OC_4H_9)_6$ as a polymerization catalyst were added to the reaction product, and the resulting mixture was polymerized at a temperature of 255° C under a highly reduced pressure of about 0.3 mm Hg for 4.5 hours to obtain an opaque polymer having a good color tone. The content of the polyalkylene glycol component in this polymer was 20% by weight.

By varying the amount of polyethylene glycol added, the same polymerization as mentioned above was carried out to obtain polyether-polyester block copolymers having the same volume ratio of 1,4-cyclohexane dimethanol component to teramethylene glycol component and polyalkylene glycol concentrations or proportions (to total copolymer) of 40, 60, 80 and 95% by weight. These polymers, impregnated with aqueous solutions of various ionic substances (electrolytes) and dried were made polymers A, which were spun the same as in Example 1 except for changing the number of the mixing elements and the amount of the polyalkylene glycol components in the resulting yarns to obtain yarns having physical properties as shown in Table 2. Each of the resulting yarns had a very low specific resistance despite the unprecedentedly small amount of polyalkylene glycol additive.

TABLE 2

| Polyalkylen glycol segment content (wt%) | POLYMER A Ionic Substance Kind | Impregnated Amount (wt%) | Specific Resistance (Ω . cm) | MIXING ELEMENT Inner Diameter (mm) | Number | Amount of the polyalylene glycol segment component in the yarn (wt%) | Specific resistance of the drawn yarn (Ω . cm) | CR Value of the drawn yarn (%) |
|---|---|---|---|---|---|---|---|---|
| 20 | Li I | 1.0 | $8 \times 10^4$ | 8.1 | 4 | .5 | $5.9 \times 10^8$ | 41.3 |
| 40 | Na I | 2.0 | $2 \times 10^5$ | 8.1 | 8 | 0.4 | $2.3 \times 10^7$ | 40.4 |
| 40 | Na I | 2.0 | $2 \times 10^5$ | 8.1 | 4 | 0.04 | $4.6 \times 10^7$ | 43.7 |
| 40 | Sodium dodecyl benzene sulfonate | 10.0 | $9 \times 10^4$ | 6.3 | 6 | 0.2 | $2.5 \times 10^8$ | 42.0 |
| 60 | K I | 2.0 | $6 \times 10^5$ | 8.1 | 8 | 0.2 | $1.0 \times 10^8$ | 42.5 |
| 80 | K I | 2.0 | $6 \times 10^5$ | 8.1 | 8 | 0.2 | $2.8 \times 10^8$ | 43.2 |
| 95 | Sodium dodecyl benzene sulfonate | 10.0 | $9 \times 10^4$ | 8.1 | 7 | 0.35 | $5.0 \times 10^8$ | 41.7 |

EXAMPLE 4

To 76.79 parts of dimethyl-2,6-naphthalene dicarboxylate, 24.81 part of 1,4-cyclohexane dimethanol and 30.0 parts of ethylene glycol were added 85.0 parts of polyethylene glycol (molecular weight 1,000) and 0.15 part of calcium acetate as a catalyst for an ester interchange reaction. The resulting mixture was subjected to an ester interchange reaction while distilling off methanol at a temperature of 140° – 220° C. Thereafter, to the reaction product was added 0.07 part of antimony oxide, 17.0 parts of sodium dodecyl benzene sulfonate, 0.05 part of silicone oil, 0.08 part of trimethyl phosphate, 0.17 part of Irganox 1010 (product of Ciba-Geigy Ltd.) as an antioxidant and 1.7 parts of lithium iodide. The resulting mixture was polymerized at a temperature of 255° C under a highly reduced pressure of 0.2 mm Hg for 4 hours to obtain a transparent polymer good in color tone.

The above procedure was repeated, except for changing the kind of polyalkylene glycol only, to obtain polyether-polyester block copolymers.

These polymers were made polymers A and polyethylene terephthalate having an intrinsic viscosity of 0.66 was made polymer B. These polymers A and B were mixed and spun the same as in Example 1 except for changing the number of the mixing elements and the mixing ratio to obtain drawn yarns. The physical properties of the obtained yarns are shown in Table 3.

TABLE 3

| Kind of polyalkylene glycol segment | POLYMER A Molecular Weight | Specific Resistance (Ω . cm) | MIXING ELEMENT Inner Diameter (mm) | Number | Amount of the polyalkylene glycol segment component in the yarn (wt%) | Specific Resistance of the drawn yarn (Ω . cm) | CR Value of the drawn yarn (%) |
|---|---|---|---|---|---|---|---|
| Polyethylene glycol | 600 | $2 \times 10^5$ | 8.1 | 6 | 0.2 | $1.1 \times 10^8$ | 42.3 |
| Polyethylene glycol | 1000 | $4 \times 10^5$ | 8.1 | 6 | 0.2 | $1.9 \times 10^8$ | 42.8 |
| Polyethylene glycol | 6000 | $3 \times 10^5$ | 8.1 | 6 | 0.2 | $1.7 \times 10^8$ | 43.1 |
| Polyethylene glycol | 20000 | $8 \times 10^5$ | 8.1 | 6 | 0.2 | $4.7 \times 10^8$ | 42.5 |
| Random copolymerized polyether* | 16000 | $2 \times 10^6$ | 8.1 | 6 | 0.4 | $1.3 \times 10^8$ | 41.5 |

*Polyalkylene glycol obtained by copolymerizing 70% of ethylene oxide and 30% of propylene oxide.

EXAMPLE 5

81.40 parts of adipic acid and 120.0 parts of ethylene glycol were heated to a temperature of 170° – 220° C, water produced was distilled off to carry out an esterification reaction. Thereafter, to the reaction product were added 76.5 parts of polyethylene glycol (molecular weight 2,000), 0.17 part of Irganox 1010 (product of Ciba-Geigy Ltd.) as an antioxidant and 0.07 part of antimony oxide as a polymerization catalyst. The resulting mixture was polymerized at a temperature 255° C under a highly reduced pressure of 0.3 mm Hg for 5.5 hours to obtain a transparent polymer having a good color tone. Said polymer impregnated with an aqueous solution in an amount corresponding to 15% by weight of sodium dodocyl-benzene sulfonate and dried was made polymer A (specific resistance $2 \times 10^5$ Ω.cm) and various polyesters were used as polymers B, and the mixed polymers A and B were spun using the same pack as in Example 1 to obtain results as shown in Table 4. Each of the resulting polyester fibers exhibited an excellent antistatic effect.

TABLE 4

| Polymer B | Amount of polyalkylene glycol segment in yarn (wt %) | Spinning temperature (° C) | Take-up velocity (m/min.) | Draw Ratio | Specific Resistance of the drawn yarn (Ω . cm) |
|---|---|---|---|---|---|
| Poly-p-ethylene oxybenzoate | 0.2 | 260 | 1,000 | 3.50 | $3.7 \times 10^8$ |
| Poly[ethylene-l, 2-bis(phenoxy) ethane-p,p'-dicarboxylate] | 0.3 | 290 | 1,000 | 3.40 | $2.7 \times 10^8$ |
| Polytetramethy- | | | | | |

TABLE 4-continued

| Polymer B | Amount of polyalkylene glycol segment in yarn (wt %) | Spinning temperature (° C) | Take-up velocity (m/min.) | Draw Ratio | Specific Resistance of the drawn yarn (Ω . cm) |
|---|---|---|---|---|---|
| lene terephthalate | 0.2 | 260 | 1,000 | 2.80 | $2.3 \times 10^8$ |

EXAMPLE 6

51.53 parts of sebacic acid and 100 parts of diethylene glycol were heated at a temperature of 170° – 210° C. Water produced was distilled off to carry out an esterification reaction. Thereafter, to the reaction product were added 102 parts of polyethylene glycol (molecular weight 8,000), 0.17 part of Irganox 1010 (product of Ciba-Geigy Ltd.) as an antioxidant and 0.17 part of NaHTi $(OC_4H_9)_6$ as a polymerization catalyst. The resulting mixture was polymerized at a temperature of 255° C under a highly reduced pressure of 0.3 mm Hg for different polymerization times to obtain 4 kinds of polymers having good color tone and different relative viscosity values measured in a 1% solution of o-chlorophenol.

These polymers, impregnated with lithium iodide in an amount corresponding to 1% by weight as an aqueous solution and dried in vacuo, were made polymers A (specific resistance $9 \times 10^4$ Ω.cm).

Next, spinning was carried out using each of these polymers under the same conditions as in Example 1 with ten mixing elements in the spinning pack, making the average residence time in the mixing part 8.1 seconds and making the time until the polymer A reached the spinneret exit about 24 seconds. The amount of the polyethylene glycol segment in the product yarn was 0.8% by weight. The spinning was stable from a long period of time and the specific resistance values of the drawn yarns thus obtained are shown in Table 5.

TABLE 5

| Relative viscosity of Polymer A | Specific Resistance of the drawn Yarn (Ω . cm) |
|---|---|
| 1.82 | $2.6 \times 10^8$ |
| 2.03 | $1.9 \times 10^8$ |
| 2.56 | $1.2 \times 10^8$ |
| 3.07 | $2.5 \times 10^8$ |

The data in Table 5 demonstrates that the antistatic properties of the drawn yarn are almost not influenced by the relative viscosity of polymer A.

EXAMPLE 7

Example 6 was repeated except for making the amount of sebacic acid 33.88 parts, using 46.2 parts of ethylene glycol instead of diethylene glycol and using 136.0 parts of polyethylene glycol (molecular weight 2,000) as polyalkylene glycol. Polymerization was carried out for 4 hours. The resulting polymer, impregnated with sodium dodecylbenzene sulfonate as an aqueous solution in an amount corresponding to 10% by weight and dried in vacuo, was made polymer A (specific resistance $3 \times 10^5$ Ω.cm).

Next, spinning and drawing were carried out under the same conditions as in Example 6 except for changing the inner diameter and number of the mixing elements and causing the amount of polyethylene glycol segment in the fiber to be 0.64% by weight. The specific resistance values of the fibers thus obtained were as shown in Table 6.

TABLE 6

| Mixing Part: Inner diameter (mm) | Mixing Part: Number of Elements* | Specific Resistance of the drawn yarn (Ω . cm) | Spinnability |
|---|---|---|---|
| 4.8 | 4 | $8.9 \times 10^7$ | Drawability poor |
| 4.8 | 6 | $1.6 \times 10^8$ | Drawability somewhat poor |
| 4.8 | 8 | $2.1 \times 10^8$ | Good |
| 3.1 | 10 | $6.5 \times 10^8$ | Good |
| 3.1 | 12 | $9.1 \times 10^9$ | Good |
| 3.1 | 14 | $7.3 \times 10^{10}$ | Good |
| 3.1 | 16 | $1.4 \times 10^{11}$ | Good |
| 3.1 | 18 | $3.5 \times 10^{12}$ | Good |
| 3.1 | 20 | $9.9 \times 10^{12}$ | Good |
| 3.1 | 27 | $4 \times 10^{14}$ | Good |

*Each having a halving function, i.e., dividing the composition in two.

From Table 6 it can been seen that when the number of mixing elements exceeded 16, the antistatic property was poor; when the number of mixing elements was less than or equaled to 6, the antistatic effect was satisfactory; however, the drawability at the time of spinning was poor.

COMPARATIVE EXAMPLE 3

Example 1 was repeated using polyethylene glycol (molecular weight 20,000 abbreviated as PEG-20000) and PEG-20000 with 10% by weight of sodium dodecylbenzene sulfonate added thereto (hereinafter abbreviated as PEG-20000-DBS), respectively, as polymer A. The amount of the polyalkylene glycol segment in the spinning solution was also changed. The results were as shown in Table 7.

TABLE 7

| Sample No. | Polymer A: Kind | Polymer A: Specific resistance (Ω . cm) | Amount of polyalkylene glycol segment in yarn (wt%) | Mixing Part: Inner diameter (mm) | Mixing Part: Number of elements | Specific Resistance of the drawn yarn (Ω . cm) |
|---|---|---|---|---|---|---|
| 1 | PEG-20000 | $3.2 \times 10^{10}$ | 0.5 | 8.1 | 12 | $2.1 \times 10^{12}$ |
| 2 | PEG-20000-DBS | $2.5 \times 10^9$ | 1.0 | 8.1 | 12 | $5.1 \times 10^9$ |

Although the yarn of Sample No. 2 exhibited excellent antistatic properties, these properties deteriorated when it was repeatedly washed 20 times; the specific resistance became $2.5 \times 10^{12}$ Ω.cm.

The yarn of Sample No. 2 exhibited a specific resistance lower than expected from the amount of polyalkylene glycol present and the specific resistance of polymer A. The reason therefor is not necessarily clear. However, it may be that there was some special interaction in the boundary surface between polyethylene terephthalate and polyethylene glycol.

EXAMPLE 8

In a pack structure as shown in FIG. 1, a mixing part was used which was constructed by fixing ten mixing elements in a pipe having an inner diameter of 8.1 mm. Each of these mixing elements consisted of a rectangular plate twisted 180° from end to end. These elements were arranged so that elements of right-handed and left-handed curvature alternated with one another, the angle between contacting edges of adjacent elements being about 90°. Polyethylene terephthalate, having an intrinsic viscosity of 0.64 and being melted at 291° C, was supplied as polymer B into the conduit 17 at a rate of 19.75 g/min. and caused to pass through the filter layer 12 about 18 mm. thick consisting of particles having an average particle diameter of 60 mesh. Thereafter, polymer B was introduced into the space 28 via the spaces 21, 22. On the other hand, 67.77 parts of terephthalic acid and 100 parts of 2,2-dimethylpropane-1,3-diol were heated to a temperature of 170° – 210° C. Water produced was distilled off to carry out an esterification reaction. Thereafter, to the reaction product were added 76.51 parts of polyethylene glycol (molecular weight 4,000), 0.17 part of Irganox 1010 (product of Ciba-Geigy Ltd.) as an antioxidant and 0.17 part of NaHTi $(OC_4H_9)_6$ as a polymerization catalyst. The resulting mixture was polymerized at a temperature of 255° C under a highly reduced pressure of 0.3 mm Hg for 5 hours to obtain a polymer A good in color tone.

Next, polymer A, melted and kept at 200° C, was introduced into the space 28 via the conduit 25, filter layer 26 and small hole 27 in a measured amount so that the polyalkylene ether segment of the spun product was 2.25% by weight of the total amount of polymers A and B. The molten mixture of polymers A and B was then caused to pass through the aforementioned static mixing part, with an average residence time of 19 seconds after which the molten mixture was spun, within about 35 seconds, from a spinneret having 24 spinneret orifices each having a diameter of 0.25 mm. The spun filaments thus produced were taken up at a rate of 1,000 m/min. by a conventional method to obtain an undrawn yarn. When this undrawn yarn was drawn 3.5 times to give a drawn yarn having an elongation of about 30%, it became a yarn excellent in antistatic properties having a specific resistance of $9.2 \times 10^8$ Ω.cm.

Next, this drawn yarn was immersed at a bath ratio of 1:30 in a 3% aqueous solution of caustic soda and treated at about 100° C. for 60 minutes to reduce its weight by 15.3%. The specific resistance of the post-treated yarn was $1.3 \times 10^8$ Ω.cm., a better value than that of the pre-treated yarn.

When the surface of this yarn after treatment with the an alkali was observed by an electron microscope, it was confirmed that striae twined around the yarn surface. This is believed to have played a role in enhancing the antistatic properties of the yarn.

EXAMPLE 9

Using the same apparatus as in Example 8, polymer B, polyethylene terephthalate having an intrinsic viscosity of 0.68 being melted at 293° C, was supplied to conduit 17 at a rate of 32.00 g/min.

On the other hand, to 34.09 parts of dimethyl terephthalate, 57.99 parts of dimethyl-1, 2-bis(phenoxy)ethane-p,p'-dicarboxylate, 150 parts of 1,4-cyclohexane dimethanol and 51.00 parts of polyethylene glycol (molecular weight 6,000) was added 0.15 part of calcium acetate as a catalyst for an ester interchange reaction. The resulting mixture was subjected to an ester interchange reaction while distilling off methanol at a temperature of 140° – 220° C. Thereafter, to the reaction product was added 0.07 part of antimony oxide, 0.08 part of trimethyl phosphate and 0.17 part of Irganox 1010 (product of Ciba-Geigy Ltd.) as an antioxidant. The resulting mixture was polymerized at a temperature of 255° C. under a highly reduced pressure of 0.2 mm Hg for 4 hours to obtain a polymer A good in color tone.

Next, the temperature of the polymer A melted and kept at 220° C. was gradually raised to 260° – 290° C. This molten polymer A was measured so that the polyalkylene ether segment in this polymer A might occupy 0.50% by weight in the total amount of the polymers A and B, and then introduced into the space 28. Polymer A and polymer B, immediately thereafter, were caused to pass through a static mixing part having an inner diameter of 4.8 mm and twelve elements the same as those in Example 1. Within about 3 seconds after exiting from the mixing part, the molten mixture was spun from a spinneret having thirty spinneret orifices each having a diameter of 0.25 mm. The spun filaments were taken up at a rate of 1,000 m/min. by a conventional method and the undrawn yarn thus obtained was continuously drawn 3.5 times to make it a drawn yarn having an elongation of about 30%. Next, this drawn yarn was false-twisted by a conventional method to obtain a textured yarn having a crimp resiliency (CR) of 41%. The textured yarn was treated in a 2% aqueous solution of caustic potassium to dissolve the surface and reduce the weight by 20%.

The specific resistance of the textured yarn after being treated with caustic potassium was $5 \times 10^8$ Ω.cm and the textured yarn exhibited very excellent antistatic properties.

EXAMPLE 10

Using a polyether-polyester block copolymer (polyalkylene glycol segment 60% by weight) consisting of sebacic acid, 2,2-dimethylpropane-1,3-diol and polyethylene glycol (molecular weight 2,000) as polymer A and polyethylene terephthalate as polymer B and using the same apparatus as in Example 8, melt spinning with instant mixing was carried out. The polyalkylene glycol segment constituted 0.4% by weight of the total amount of polymers A and B. Thereafter the undrawn yarn thus obtained was drawn into a yarn having an elongation of 30%.

The surface of a roll of a woven fabric obtained by using this drawn yarn was treated in a 0.4% warm aqueous solution of caustic potassium to reduce the weight by 8%. The fabric after being treated with caustic potassium exhibited very good antistatic properties, being free from dust adherence, electric discharge, crackling and clinging to the body of the wearer at the time of wearing.

COMPARATIVE EXAMPLE 4

To 26.16 parts of dimethyl terephthalate, 26.16 parts of dimethyl isophthalate and 80 parts of diethylene glycol were added 119.0 parts of polyethylene glycol (molecular weight 6,000) and 0.15 part of calcium acetate as a catalyst for an ester interchange reaction. The resulting mixture was subjected to an ester interchange reaction while distilling off methanol at a temperature of 140° – 220° C. Thereafter, to the reaction product were added 0.07 part of Irganox 1010 (product of Ciba-Geigy Ltd.) as an antioxidant, and the resulting mixture was polymerized at a temperature of 255° C. under a highly reduced pressure of 0.2 mm Hg for 4 hours. The resulting polymer, having good color tone, was made polymer A.

Using as polymer B, poly-1,4-cyclohexane dimethylene terephthalate having a molecular weight of about 23,000 and using the same apparatus as in Example 8, mix spinning was carried out at a polyalkylene glycol segment content in the final product of 0.9% by weight. The undrawn yarn was drawn into a yarn having an elongation of 30% and a specific resistance of $1.3 \times 10^{10}$ Ω.cm.

When the surface of said drawn yarn was treated with a 15% hot aqueous solution of caustic soda to reduce the weight by 8%, the specific resistance after being treated increased drastically to $3.2 \times 10^{12}$ Ω.cm. This drawn yarn was very inferior in antistatic properties.

EXAMPLE 11

In the pack structure like that shown in FIG. 1, a mixing part was included consisting of ten mixing elements in a pipe having an inner diameter of 8.1 mm. Each mixing element was made by twisting a rectangular plate 180° from end to end. These elements were arranged so that elements of right-handed and left-handed curvature alternated with one another and the angle between contacting edges of adjacent elements was about 90°. Polymer B, polyethylene terephthalate having an intrinsic viscosity of 0.66 and being melted at 290° C. was supplied to conduit 17 at a rate of 30 g/min. and caused to pass through the filter layer 12 of about 20 mm. thick consisting of particles having an average particle diameter of 60 mesh. Thereafter polymer B was introduced into the space 28 via the spaces 21,22. On the other hand, to 26.52 parts of dimethyl terephthalate, 9.36 parts of 1,4-cyclohexane dimethanol and 21.0 parts of diethylene glycol were added 136.0 parts of polyethylene glycol (molecular weight 20,000) and 0.17 part of $NaHTi(OC_4H_9)_6$ as a catalyst for an ester interchange reaction, and while distilling off methanol at a temperature of 140° – 220° C., the resulting mixture was subjected to an ester interchange reaction. Thereafter, to the reaction product were added 0.08 part of trimethyl phosphate and 0.17 part of Irganox 1010 (product of Ciba-Geigy Ltd.) as an antioxidant and the resulting mixture was polymerized at a temperature of 250° C. under a highly reduced pressure of 0.2 mm Hg to obtain a polymer A good in color tone.

The temperature of said polymer A melted and kept at 180° C. in nitrogen atmosphere, was gradually raised to 260° – 290° C. Next, the resulting molten polymer A was introduced to the space 28 via the conduit 25, filter layer 26 and small hole 27 in an amount so that the polyalkylene glycol segment in this polymer A constituted 1.0% by weight of the combined polymer A-polymer B composition. The combined molten polymers A and B, immediately thereafter, were caused to pass through the aforementioned static mixing part within an average residence time of 12.4 seconds and the resulting mixture was spun thereafter within about 24 seconds from a spinneret having thirty-six spinneret orifices each having a diameter of 0.3 mm. The spun filaments were taken up at a rate of 1,000 m/min., by a conventional method to obtain an undrawn yarn, which was further drawn 3.5 times into a drawn yarn having an elongation of about 30%.

When the residence time of polymer A in a molten state was 0.4 hour, the specific resistance of the drawn yarn product was $1.6 \times 10^{10}$ Ω.cm. Spinning was continued until the molten resistance time reached 20 hours. Even at the end, the resulting filaments had a specific resistance of $1.2 \times 10^{10}$ Ω.cm.

The melting point of a polyester of the same component as the polyester segment obtained by polymerization without adding polyalkylene glycol in the synthesis of this example was 185° C.

COMPARATIVE EXAMPLE 5

In a test like that described in Example 11, polymer A consisted of polyethylene terephthalate obtained by copolymerizing 50% by weight of polyethylene glycol having a molecular weight of 20,000 and adding 10% by weight of sodium dodecylbenzene sulfonate at the time of polymerization. This polymer A was melted and stored at 270° C, united with the polymer B so that the amount of polyalkylene glycol in the yarn was 0.5% by weight and the united polymers A and B were caused to pass through 12 mixing elements, in a pipe having an inner diameter of 6.3 mm, and spun.

Although the specific resistance of the drawn yarn thus obtained was $5.6 \times 10^9$ Ω.cm. when the residence time in a molten state of polymer A was 0.4 hour, it became $8.1 \times 10^{12}$ Ω.cm. when said time was 3.0 hours with poor antistatic performance. When the tank of the molten polymer A was opened at this time a strong odor was noted due to decomposition of polymer A.

The melting point of the polyethylene terephthalate of this example without polyethylene glycol was 264° C.

EXAMPLE 12

Using poly[ethylene-1,2-bis(phenoxy)ethane-p,p'-dicarboxylate]as polymer B and using what was obtained by adding 10% by weight of sodium dodecylbenzene sulfonate to 40% by weight copolymerized polydiethylene adipate of polyalkylene glycol (molecular weight 16,000) obtained by random copolymerization of 70% of ethylene oxide and 30% of propylene oxide, melted and stored at 80° C., as polymer A, these polymers A and B were spun using the apparatus shown in FIG. 1, in which as mixing elements in the mixing part, twelve elements each having an inner diameter of 6.3 mm. were used, at a spinning temperature of 290° C. in such a manner that the amount of the polyalkylene glycol in the fiber product was 0.4% by weight. The undrawn yarn product was drawn 2.7 times.

The specific resistance values of the drawn yarn, corresponding to residence times in a molten state of polymer A, of 0.4, 20, 100 hours were $9.3 \times 10^8$, $7.1 \times 10^8$ and $8.5 \times 10^8$ Ω.cm., respectively, and the spinnability was very good.

The melting point of polydiethylene adipate polymerized without adding the polyalkylene glycol thereto was below 0° C.

EXAMPLE 13

To 10.85 parts of isophthalic acid, 40.0 parts of tetramethylene glycol and 144.5 parts of polyethylene glycol (molecular weight 4,000) was added 0.17 part of $NaHTi(OC_4H_9)_6$ as a catalyst for esterification. The resulting mixture was subjected to an esterification reaction while distilling off water at a temperature of 170° – 220° C. Thereafter, to the reaction product were added 0.05 part of $NaHTi(OC_4H_9)_6$, 0.08 part of trimethyl phosphate and 0.17 part of Irganox 1010 (product of Ciba-Geigy Ltd.) as an antioxidant, and the resulting mixture was polymerized at a temperature of 255° C. under a highly reduced pressure of 0.2 mm Hg for 4 hours to obtain a transparent polymer having good color tone.

This polymer impregnated with sodium benzenesulfonate in an amount corresponding to 15% by weight as an aqueous solution and dried was made polymer A in carrying out mix spinning under the same conditions as in Example 1 except for making the melted and stored temperature of the polymer A, 120° C., and adding an amount of polymer A such that the amount of polyalkylene glycol segment in the yarn was 0.05% by weight. The specific resistance values of the drawn yarn at melted and stored times for polymer A of 0.4, 50, 200 and 500 hours were $3.7 \times 10^{10}$, $1.7 \times 10^{10}$, $1.3 \times 10^{10}$ and $3.3 \times 10^{10}$ Ω.cm, respectively.

The melting point of polytetramethylene isophthalate polymerized without adding polyethylene glycol was 133° C.

EXAMPLE 14

An apparatus of the type shown in FIG. 1 was constructed with mixing part 23 consisting of ten mixing elements in a pipe having an inner diameter of 8.1 mm. Each of these mixing elements was obtained by twisting a rectangular plate by 180° end to end, arranged so that elements of right-handed and left-handed curvature alternate with one another, the angle between contacting edges of adjacent elements being about 90°. This apparatus was then used in melt spinning as described below.

Polymer B in this experiment was obtained by melting at 290° C. polyethylene terephthalate having an intrinsic viscosity of 0.65. This polymer B was supplied at a rate of 83.0 g/min. into the conduit 17, and caused to pass through the filter layer 12 (the height of which was about 18 mm.) consisting of stainless steel particles having an average particle diameter of 60 mesh. Thereafter polymer B was introduced into the space 28 via the spaces 21, 22.

On the other hand, to 47.86 parts of dimethyl terephthalate, 47.86 parts of dimethyl isophthalate, 100 parts of ethylene glycol and 76.50 parts of polyethylene glycol (molecular weight 4,000) was added 0.15 part of calcium acetate as a catalyst for an ester interchange reaction. The resulting mixture was subjected to an ester interchange reaction while distilling off methanol at a temperature of 140°–220° C. Thereafter, to the reaction product were added 0.07 part of antimony oxide, 0.08 part of trimethyl phosphate and 0.17 part of Irganox 1010 (product of Ciba-Geigy Ltd.) and the resulting mixture was polymerized at a temperature of 255° C. under a highly reduced pressure of 0.2 mm Hg for 4 hours to obtain a polymer good in color tone, which was made polymer A. This polymer A was kept molten at 130° C, and the temperature was then gradually raised to 260°–290° C. This polymer A was then discharged into space 28 via conduit 25, filter layer 26 and small hole 27 in a measured amount so that the polyalkylene glycol segment comprised 0.135% by weight of the entire mixed polymer composition. The combined polymer A-polymer B composition flow was passed through the static mixing part with an average residence time of five seconds, and the resulting mixed flow was spun within nine seconds thereafter from a spinneret having thirty spinneret orifices each having a diameter of 0.3 mm. The spun yarn was taken up at a rate of 3,000 m/min. to obtain a yarn having an elongation of 180%, a tenacity of 2.3 g/d and a birefringence of $32 \times 10^{-3}$. This yarn exhibited substantially no crystalline interference under X-ray inspection. This amorphous, highly oriented (pre-oriented) polyester yarn exhibited a specific resistance of $1.1 \times 10^{10}$ Ω.cm, and had good antistatic performance.

EXAMPLE 15

In an apparatus of the type shown in FIG. 1, twelve mixing elements consisting of rectangular plates twisted 180° end to end were arranged in a pipe having an inner diameter of 6.3 mm. so that elements of right-handed and left-handed curvature alternate with one another, the angle between contacting edges of adjacent elements being about 90°. This apparatus was used in carrying out the following melt spinning with instant mixing.

As polymer B, polyethylene terephthalate having an intrinsic viscosity of 0.70, melted at 290° C, was supplied into the conduit 17 at a rate of 60.0 g/min. and caused to pass through a filter layer 12 (whose height was about 10 mm.) consisting of particles having an average particle diameter of 80 mesh. Thereafter, polymer B was introduced into the space 28, via the spaces 21, 22.

On the other hand, to 45.99 parts of dimethyl terephthalate, 19.71 parts of dimethyl isophthalate and 50.0 parts of ethylene glycol were added 96.0 parts of polyethylene glycol (molecular weight 6,000), 17.0 parts of $NaHTi(OC_4H_9)_6$ as a catalyst for an ester interchange reaction. The resulting mixture was subjected to an ester interchange reaction while distilling off methanol at a temperature of 140°–220° C. Thereafter, to the reaction product were added 0.08 part of trimethyl phosphate and 0.17 part of Irganox 1010 (product of Ciba-Geigy Ltd.) as an antioxidant, the resulting mixture was polymerized at a temperature of 255° C. under a highly reduced pressure of 0.2 mm Hg and the polymer thus obtained good in color tone, was polymer A. This polymer A was kept molten at 200° C. and the temperature was gradually raised to 260°–290° C. The resulting molten polymer A was discharged into the space 28 via the conduit 25, filter layer 26 and small hole 27 in a measured amount so that the polyalkylene glycol segment comprised 0.30% by weight of the entire polymer composition. This combined polymer composition was then caused to pass through the static mixing part with an average residence time of thirty-five seconds, and the mixed flow was spun within twelve seconds thereafter from a spinneret having twenty-four spinneret orifices each having a diameter of 0.25 mm. The spun yarn thus obtained was wound up at a rate of 3,000 m/min. to obtain an undrawn yarn having an elongation of 170%, a tenacity of 2.5 g/d, a birefringence of $40 \times 10^{-3}$. Substantially no crystalline interference figure was observed in X-ray inspection. Next, said undrawn yarn was drawn and false-twisted using a Super Draw Set Two Machine manufactured by E. Scragg Co., at a hot plate temperature of 220° C., number of twists of 2,800T/M and a draw ratio of 1.75. No knot was observed in the textured yarn thus obtained, which was a good quality-textured yarn with fibrillation resistance comparable to that of the corresponding yarn without polymer A. Woven and knitted fabrics using this textured yarn were very good in antistatic properties and when they were worn as clothing, they were free from electric discharge and clinging to the body of the wearer and also relatively free from dust adherence.

The estimation of fibrillation resistance in this example was carried out according to the following method.

A false-twisted yarn was knitted into a fabric, which was dyes a dark color (a color of the black series is preferable for this test). Thereafter, using a Universal type abrasion tester, an abrasion test was carried out using a plane rubbing method; the time until fibrillation took place and the color of the yarn became white was measured. This fibrillation resistance was estimated by a comparative value of that time relative to a time measured by treating similarly false-twisted yarn without polymer A added.

EXAMPLE 16

In an apparatus of the type shown in FIG. 3, with a spinneret of the parallel spinning type, as shown in FIG. 5, as the mixing part, twelve mixing elements in a pipe having an inner diameter of 8.1 mm was used. Each of these mixing elements was obtained by twisting a rectangular plate 180° from end to end and these elements were arranged so that elements of right-handed and left-handed curvature alternated with one another; the angle between contacting edges of adjacent elements was about 90°. The spinneret had twelve of each type of spinneret orifices 30, 30' (totalling 24 orifices), each having a diameter of 0.3 mm. In this apparatus, mix spinning was carried out as described below.

To 47.86 parts of dimethyl terephthalate, 47.86 parts of dimethyl isophthalate, 100 parts of ethylene glycol and 76.50 parts of polyethylene glycol (molecular weight 4,000) was added 0.15 part of calcium acetate as a catalyst for an ester interchange reaction. The resulting mixture was subjected to an ester interchange reaction while distilling off methanol at a temperature of 140°–220° C. Thereafter, to the reaction product were added 0.07 part of antimony oxide, 0.08 part of trimethyl phosphate and 17 parts of sodium lauryl sulfate, and the resulting mixture was polymerized at a temperature of 255° C under a highly reduced pressure of 0.2 mm Hg for 4 hours to obtain a polymer good in color tone, which was used as polymer A in this process.

As polymer B, polyethylene terephthalate polymer prepared according to a conventional method having an intrinsic viscosity measured in $\sigma$-chlorophenol at 25° C of 0.66 and a softening point of 261° C was used.

As polymer B', a copolymer was formed with phthalic acid as an added acid component in a ratio of terephthalic acid to phthalic acid of 9:1 at the time of polymerization. This copolymer had an intrinsic viscosity of 0.68 and a softening point of 242° C.

With the entire apparatus at 290° C, polymer B and polymer B' were supplied from the conduits 17 and 17', respectively, at a rate of 10 g/min, respectively. Polymer A was discharged into the space 28 via the conduits 25, 27 of FIG. 3 in a measured rate so that the amount of the polyester segment in the entire fiber would be 0.3% by weight. Polymers A and B were mixed in the static mixing part and spun through the spinneret orifices 30 to give antistatic filaments.

On the other hand, polymer B' was spun through the spinneret orifices 30' to give copolymer filaments. By simultaneously taking up these two fibers, an antistatic polymer filament mixed yarn was obtained. This mixed yarn had a specific resistance of $2.5 \times 10^9$ Ω.cm, and exhibited excellent antistatic characteristics.

EXAMPLE 17

In the structure of FIG. 4, holes **10*a* were distributed at regular intervals on a circumference as 30 orifices, each having a diameter of 0.3 mm and a length of 0.6 mm, while holes 19*a*** were distributed at regular intervals on a circumference as thirty orifices, each having a diameter of 0.3 mm and a length of 0.6 mm. The mixing part consisted of ten mixing elements in a pipe having an inner diameter of 8.1 mm. Each of these mixing elements was obtained by twisting a rectangular plate 180° end to end. These elements were arranged so that elements of right-handed and left-handed curvature alternated with one another, the angle between contacting edges of adjacent elements being about 90°.

To 50 parts of dimethyl terephthalate, 50 parts of dimethyl isophthalate, 100 parts of ethylene glycol and 113.4 parts of polyethylene glycol (molecular weight 4,000) was added 0.2 part of NaHTi $(OC_4H_9)_6$ as a catalyst for an ester interchange reaction. The resulting mixture was subjected to an ester interchange reaction while distilling off methanol at a temperature of 140°–220° C. Thereafter, to the reaction product were added 0.1 part of trimethyl phosphate and 25.2 parts of sodium lauryl sulfonate and the resulting mixture was polymerized at a temperature of 250° C under a highly reduced pressure of 0.2 mm Hg for 4 hours to obtain a polymer A good in color tone.

The temperature of said polymer A melted and kept at 150° C in nitrogen atmosphere was gradually raised to 260°–290° C. Next, the polymer A was introduced into the meeting part **16*a* via the space 14*a*** in measured amount so that the amount of the polyalkylene glycol segment in this polymer A would be 0.8% by weight of the entire mixed polymer composition.

On the other hand, as polymer B, a polyethylene terephthalate having an intrinsic viscosity of 0.70 melted at 295° C was distributed to the passageways **7*a* and 8*a* via space 5. The polymer B proceeding to the passageway 8*a* was united with the polymer A discharged from said holes 15*a* at the meeting part 16*a*. Thereafter, this mixture passed through the mixing part 17*a*, becoming a core component via 18*a*, 19*a*. On the other hand, polymer B proceeding through passageway surrounded the outside of the polymer blended with the polymer A discharged from the holes 19*a* at the meeting part 12*a* via the openings 9*a*, 10*a*, 11*a***; thereafter, being discharged as a conjugate filament at a rate of 88.0 g/min. A spinning oil was supplied to the surface of said filament; thereafter, said filament was wound up at a rate of 3,000 m/min to obtain a sheath-core conjugate polyester filament having an elongation at break of 175%. Said conjugate filament had a specific resistance of $9.8 \times 10^8$ Ω.cm, thus exhibiting an excellent antistatic performance.

Further, said conjugate filament was drawn or subjected to a texturing process such as drawing and false-twisting. Its processing, uniformity of quality and antistatic performance did not change at all even after 3 months.

EXAMPLE 18

Polymer A was prepared as follows. To 26.16 parts of dimethyl terephthalate, 26.16 parts of dimethyl isophthalate, 40 parts of tetramethylene glycol and 144.5 parts of polyethylene glycol (molecular weight 4,000) was added 0.15 part of calcium acetate as a catalyst for an ester interchange reaction. The resulting mixture was subjected to an ester interchange reaction while distilling off methanol at a temperature of 140°–220° C. Thereafter, to the reaction product were added 0.07 part of antimony oxide, 0.08 part of phosphorous acid, 17 parts of sodium dodecylbenzene sulfonate and various antioxidants as shown in Table 8. The resulting mixtures were polymerized at a temperature of 255° C under a highly reduced pressure of 0.2 mm Hg for 4 hours to obtain polymers good in color tone.

On the other hand, as polymer B, polyethylene terephthalate having an intrinsic viscosity of 0.64 blended with 0.5% of titanium oxide, colored in white, melted at 290° C was used. Using the pack structure of FIG. 1 the same as that in Example 1, upon spinning the polymer A and the polymer B, the polymer B was supplied to the conduit 17 in measured amounts so that the polymer B was supplied at a rate of 20 g/min. On the other hand, each of the aforesaid polymers A and B was introduced into the space 28 via the conduit 25, filter layer 26, and small hole 27 in measured amount so that the polyether segment of the polymer A would be 0.35% by weight of the entire composition. The mixed polymers A and B were spun by a conventional method and taken up at a rate of 1,000 m/min to obtain undrawn yarns, which were drawn 3.5 times to obtain 50 d/36 filament drawn yarns having elongations of about 30%. These drawn yarns had specific resistance values ($R_{so}$) all within the range of $10^8$–$10^9$ Ω.cm, thus exhibiting good antistatic properties. Next, when samples of these measured drawn yarns were allowed to stand in circulating hot air at 180° C for 5 minutes and when their specific resistance values ($R_{si}$) were measured, it became clear, as shown in Table 8, that the presence of antioxidants and the nature and proportion and the kind thereof had a great effect on the antistatic properties. And as an index of the effectiveness of the antioxidant, the temperature at which oxidative decomposition started of a lauryl alcoholethylene oxide ten-mole adduct was adopted. Any antioxidant with which said temperature is above 180° C can be used with excellent effect.

TABLE 8

| ANTIOXIDANT Trade Name or Chemical Name | Adding Amount (a) | Temperature at which Oxidation decomposition of a lauryl alcohol-ethylene oxide ten-mole adduct started (° C) (b) | Specific Resistance (Ω . cm) of the Yarn: Before heat-Treatment (Rso) | After heat-treatment in air 180° C × 5 min. (Rsi) |
|---|---|---|---|---|
| None | — | — | $52 \times 10^8$ | $38.200 \times 10^8$ |
| Irganox 1010 (product of Ciba-Geigy Ltd.) | 0.1 | 180 | $16 \times 10^8$ | $238 \times 10^8$ |
| Irganox 1010 | 1 | 200 | $11 \times 10^8$ | $56 \times 10^8$ |
| Irganox 1010 | 10 | 250 | $9.3 \times 10^8$ | $9.8 \times 10^8$ |
| Ionox 330 (product of Shell Chemical Co.) | 1 | 200 | $12 \times 10^8$ | $96 \times 10^8$ |
| Zinc-di-n-butyl dihydrocarbamate | 1 | 220 | $21 \times 10^8$ | $120 \times 10^8$ |
| Diphenyl Sulfide | 1 | 135 | $4 \times 10^8$ | $9,650 \times 10^8$ |

NOTE:
(a) Weight % based on the polymer A
(b) A value obtained by subjecting the adduct added with antioxidant (1% by weight of total amount) carried on a carrier of α-alumina to differential thermal analysis at a temperature raising ratio of 20° C/min.

EXAMPLE 19

The drawn yarn with Ionox 330 added in Table 8 of Example 18 was further contacted through a half circumference with the surface of a cylinder having a diameter of 25 mm heated to 220° C at a velocity of 200 m/min so that about half of the filaments would be randomly heat-treated. The heat treated yarn had a specific resistance of $10 \times 10^8$ Ω.cm, thus exhibiting very good antistatic performance in spite of the high temperature treatment.

What is claimed is:

1. A polyester filament having excellent antistatic properties which comprises a composition of (1) a polyester selected from one group consisting of polyethylene terephthalate, polytetramethylene terephthalate, polyethylene-2, 6-napthalene dicarboxylate, poly-1, 4-cyclohexanedimethylene terephthalate poly [ethylene-1, 2-bis (phenoxy) ethane-p, p'-dicarboxylate] and poly-p-ethylene oxybenzoate, and (2) a polyether-polyester block copolymer consisting of polyalkylene glycol and polyester wherein at least 40 mol % of the polyester segment of said polyether-polyester block copolymer comprises polyester constituents synthesized from at least one member selected from the group consisting of:

A. an aliphatic or alicyclic oxycarboxylic acid having at least 2 carbon atoms and ester-forming derivatives thereof, B. an aliphatic or alicyclic dicarboxylic acid having at least 3 carbon atoms and ester-forming derivatives thereof, C. an aromatic dicarboxylic acid or oxycarboxylic acid having a group ether-linked with an aromatic ring having a carboxyl group and ester-forming derivatives thereof, D. an aromatic dicarboxylic acid or oxycarboxylic acid having a substituent group at the orthoposition toward a carboxyl group and ester-forming derivatives thereof, and E. an aliphatic or alicyclic glycol having at least 3 carbon atoms, wherein said polyester filament includes 0.01–5.0% of said polyalkylene glycol by weight of said polyester filament, and has a specific resistance less than $10^{11}$ Ω.cm and said polyether-polyester block copolymer is dispersed as fine striae along the filament axis, at least one of said striae being substantially endless.

2. A polyester filament according to claim 1 wherein the maximum diameter of said substantially endless stria is within the range of 0.01–5 microns.

3. A polyester filament according to claim 1 wherein polyalkyleneglycol comprises 0.01–5.0% by weight of said polyester filament.

4. A polyester filament according to claim 1 wherein said specific resistance is less than $10^9$ Ω.cm.

5. A polyester filament according to claim 1 wherein said polyether-polyester block copolymer is obtained by copolymerizing 10.0–97.5% polyalkylene glycol having an average degree of polymerization of 10–1000 with a polyester.

6. A polyester filament according to claim 1 wherein said polyether-polyester block copolymer contains at least one ionic substance selected from the group consisting of the following formulae:

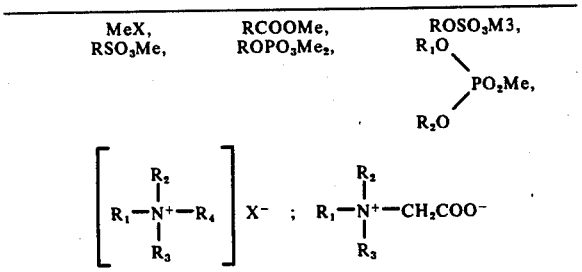

(wherein R, $R_1$, $R_2$, $R_3$, $R_4$ stand for alkyl, aralkyl, alkaryl groups having 1–30 carbon atoms, Me stands for a metal ion of a metal of Group I of the Periodic Table, and X stands for a halogen ion or an alkyl sulfate ion having 1–30 carbon atoms).

7. A polyester filament according to claim 3 wherein said polyalkylene glycol is polyethylene glycol.

8. A polyester filament according to claim 1 wherein the polyester segment constituting said polyether-polyester block copolymer is amorphous.

9. A polyester filament according to claim 1 wherein the polyester segment constituting said polyether-polyester block copolymer has a melting point less than 240° C.

10. A polyester filament according to claim 1 which has an elongation at break less than 250%.

11. A polyester filament according to claim 1 wherein said polyether-polyester block copolymer is dispersed in the central portion of the cross section of said filament and the surface layer of said filament is substantially composed of polyester only.

12. A polyester filament according to claim 1 whose specific resistance after it is heat treated in circulating air at 180° C for 5 minutes is less than $10^{11}$ Ω.cm.

13. A polyester filament according to claim 1 whose specific resistance after at least 5% of its weight is decreased by being treated with an alkali solution is less than $10^{11}$ Ω.cm.

14. A polyester filament according to claim 1 which contains at least one antioxidant.

15. Woven or knitted fabrics comprised of the filament obtained in claim 1.

16. A polyester filament mixed yarn consisting of a filament as defined in claim 1 combined with a filament which is substantially free of polyether-polyester block copolymer.

17. A polyester filament as defined in claim 1 wherein a plurality of said striae in said filament are substantially endless.

18. A yarn composed of a plurality of filaments as defined in claim 1.

* * * * *